US009327173B2

(12) United States Patent
Mizutani

(10) Patent No.: US 9,327,173 B2
(45) Date of Patent: May 3, 2016

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 149 days.

(21) Appl. No.: 14/282,938

(22) Filed: May 20, 2014

(65) Prior Publication Data

US 2014/0349779 A1 Nov. 27, 2014

(30) Foreign Application Priority Data

May 21, 2013 (JP) ..... 2013-106724

(51) Int. Cl.
*A63B 53/06* (2015.01)
*A63B 53/04* (2015.01)
*A63B 71/06* (2006.01)

(52) U.S. Cl.
CPC ..... *A63B 53/06* (2013.01); *A63B 53/0466* (2013.01); *A63B 2053/0433* (2013.01); *A63B 2053/0491* (2013.01); *A63B 2071/0694* (2013.01); *A63B 2225/09* (2013.01)

(58) Field of Classification Search
CPC ..... A63B 2053/0491; A63B 2053/0433; A63B 53/06
USPC ..... 473/338, 335, 336, 337, 339, 349
See application file for complete search history.

(56) References Cited

U.S. PATENT DOCUMENTS

| | | | | |
|---|---|---|---|---|
| 7,670,235 | B2 * | 3/2010 | Lo | A63B 53/0466 473/332 |
| 7,744,484 | B1 * | 6/2010 | Chao | A63B 53/0466 473/324 |
| 8,944,934 | B2 * | 2/2015 | Yamamoto | A63B 53/0466 473/334 |
| 2004/0092332 | A1 * | 5/2004 | Willett | A63B 53/0466 473/338 |
| 2008/0132353 | A1 | 6/2008 | Hsiao | |
| 2009/0131200 | A1 | 5/2009 | Akinori et al. | |
| 2010/0323815 | A1 * | 12/2010 | Bezilla | A63B 53/04 473/335 |
| 2012/0172142 | A1 | 7/2012 | Yashiki | |
| 2014/0024475 | A1 * | 1/2014 | Motokawa | A63B 53/06 473/338 |

FOREIGN PATENT DOCUMENTS

| | | | |
|---|---|---|---|
| JP | 3142270 | U | 5/2008 |
| JP | 2012-139403 | A | 7/2012 |

* cited by examiner

*Primary Examiner* — Benjamin Layno
(74) *Attorney, Agent, or Firm* — Birch, Stewart, Kolasch & Birch, LLP

(57) ABSTRACT

A head 4 includes a head main body h1, a socket 10, an attachment member 11, and a weight body 12. The head main body h1 includes a socket housing portion 14. The socket 10 is attached to the socket housing portion 14. The socket housing portion 14 includes a first opening K1 through which the socket 10 can be housed. The attachment member 11 is mechanically joined to the head main body h1. The attachment member 11 is disposed so as to block at least a part of the first opening K1. The attachment member 11 controls the falling off of the socket 10 from the first opening K1. The socket 10 includes a held portion 10*b*. The held portion 10*b* is pressed by the attachment member 11. The socket 10 is formed of a polymer.

12 Claims, 26 Drawing Sheets

E P

E P

GOLF CLUB HEAD

The present application claims priority on Patent Application No. 2013-106724 filed in JAPAN on May 21, 2013, the entire contents of which are hereby incorporated by reference.

BACKGROUND OF THE INVENTION

1. Field of the Invention

The present invention relates to a golf club head including a weight body.

2. Description of the Related Art

A head in which a weight body is replaceable is known. The position of the center of gravity of the head and the weight of the head can be adjusted by changing the weight of the weight body.

As a mechanism for attaching the weight body, a screw mechanism is typically used. Meanwhile, Japanese Utility Model Registration Publication No. 3142270 (US2009/0131200) discloses a mechanism including a sleeve and a weight. The sleeve is formed of a flexible material. Japanese Patent Application Laid-Open Publication No. 2012-139403 (US2012/0172142) discloses a head cavity body mounted on a head and a head weight attachable to and detachable from the head cavity body. The material of the head cavity body is a polymer. In these publications, the weight can be attached by rotating the weight at a predetermined angle, and the weight can be detached by rotating the weight oppositely at a predetermined angle.

SUMMARY OF THE INVENTION

Preferably, the weight body can be easily attached and easily detached. From the viewpoint of convenience, preferably, attaching and detaching work is easy.

On the other hand, it is necessary to maintain the fixed state of the weight body during play. In hitting a ball, a strong impact force is applied from the ball to the head. Moreover, the head can collide against the ground in impact. The weight body is apt to detach from the head. From the viewpoint of reliability, preferably, the weight body is fixed more securely.

It is an object of the present invention to provide a highly reliable golf club head, to and from which a weight body is attachable and detachable.

A head according to an embodiment of the present invention includes a head main body, an attachment member, a socket, and a weight body. The head main body includes a socket housing portion. The socket is attached to the socket housing portion. The socket housing portion includes a first opening through which the socket can be housed. The attachment member is mechanically joined to the head main body. The attachment member is disposed so as to block at least a part of the first opening. The attachment member controls falling off of the socket from the first opening. The socket includes a held portion. The held portion is pressed by the attachment member. The socket is formed of a polymer whose elastic modulus is lower than an elastic modulus of the head main body. The weight body is detachably attached to the socket.

The first opening may be opened to the outer side of the head. Preferably, the attachment member is a ring member. Preferably, the ring member is disposed so as to block a part of the first opening. Preferably, the ring member includes a second opening through which the weight body can be inserted into the socket.

Preferably, relative rotation is enabled between the weight body and the socket. Preferably, the relative rotation allows the weight body to be placed at an engaging position and a non-engaging position. Preferably, the ring member includes an indication. Preferably, the indication facilitates determination whether the weight body is at the engaging position or not.

Preferably, the socket further includes an intermediate portion. Preferably, the intermediate portion is positioned between the ring member and the weight body. Preferably, the ring member contacts at least a part of an outer side surface of the intermediate portion.

The first opening of the socket housing portion may be opened to an inner side of a head. In this case, preferably, the socket housing portion further includes a third opening opened to an outer side of the head. Preferably, the third opening allows the weight body to be inserted and controls falling off of the socket to the outer side of the head.

Preferably, the held portion is held between the attachment member and the head main body.

Preferably, a space is provided between the held portion and the attachment member.

Preferably, the socket further includes an intermediate portion. Preferably, the intermediate portion is positioned between the attachment member and the weight body. Preferably, the attachment member does not directly contact the weight body.

Preferably, the socket housing portion includes a bottom portion. Preferably, the bottom portion includes an inward extending portion and a through hole. Preferably, the inward extending portion supports a bottom face of the socket.

A specific gravity of the head main body is G1, a specific gravity of the attachment member is G2, and a specific gravity of the socket is G3. In this case, preferably, the specific gravity G1 is greater than the specific gravity G2. Preferably, the specific gravity G2 is greater than the specific gravity G3.

Preferably, the socket housing portion includes a side wall portion. Preferably, an outer diameter of the side wall portion is constant.

DESCRIPTION OF THE PREFERRED EMBODIMENTS

In the following, the present invention will be described in detail based on preferred embodiments with appropriate reference to the drawings. It is noted that for convenience, in the present application, the outer side of a head is also referred to as the upper side and the inner side of the head is also referred to as the lower side.

A golf club head according to an embodiment includes a weight body attaching/detaching mechanism. The mechanism satisfies the Golf Rules defined by R&A (Royal and Ancient Golf Club of Saint Andrews). That is, the weight body attaching/detaching mechanism satisfies requirements specified in "lb. Adjustability" in "1. Clubs" in "Appendix II. Design of Clubs" defined by R&A. The requirements defined by the "lb Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
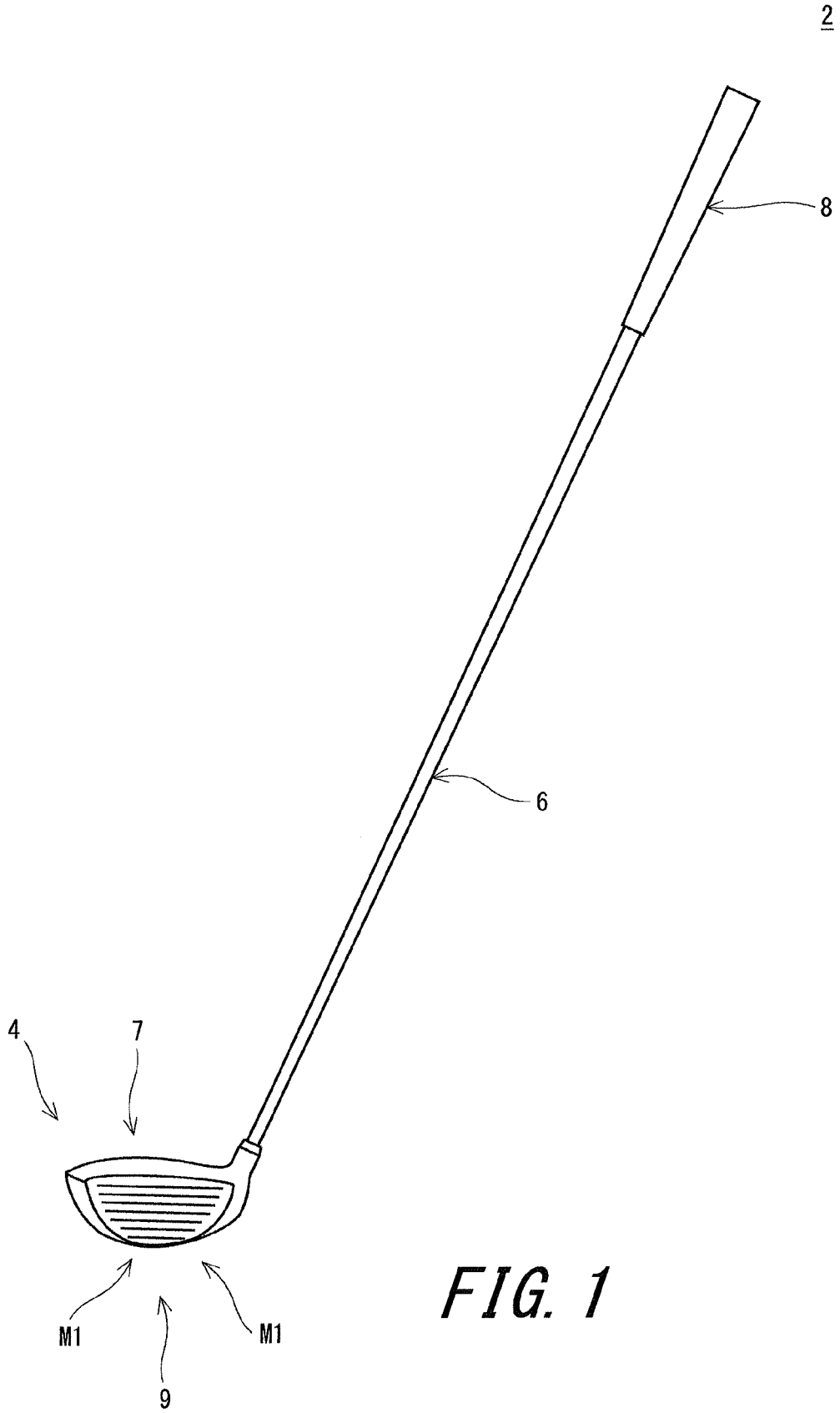
FIG. 1 is an overall view of a golf club including a head according to a first embodiment of the present invention.

FIG. 1 is a golf club 2 including a head 4 according to a first embodiment. The golf club 2 includes the head 4, a shaft 6, and a grip 8. The head 4 is attached to one end portion of the shaft 6. The grip 8 is attached to the other end portion of the shaft 6. The head 4 includes a crown 7 and a sole 9. The head 4 is hollow.

The head 4 is a wood type head. The real loft angle of the wood type head is usually 8 degrees or greater and 34 degrees or less. The head volume of the wood type head is usually 120 cc or greater and 470 cc or less.

The head 4 is an exemplary. The head 4 includes a wood type head, a utility type head, a hybrid type head, an iron type head, and a putter type head. The shaft 6 is a tubular body. The shaft 6 includes a steel shaft and a so-called carbon shaft.

Figure 2:
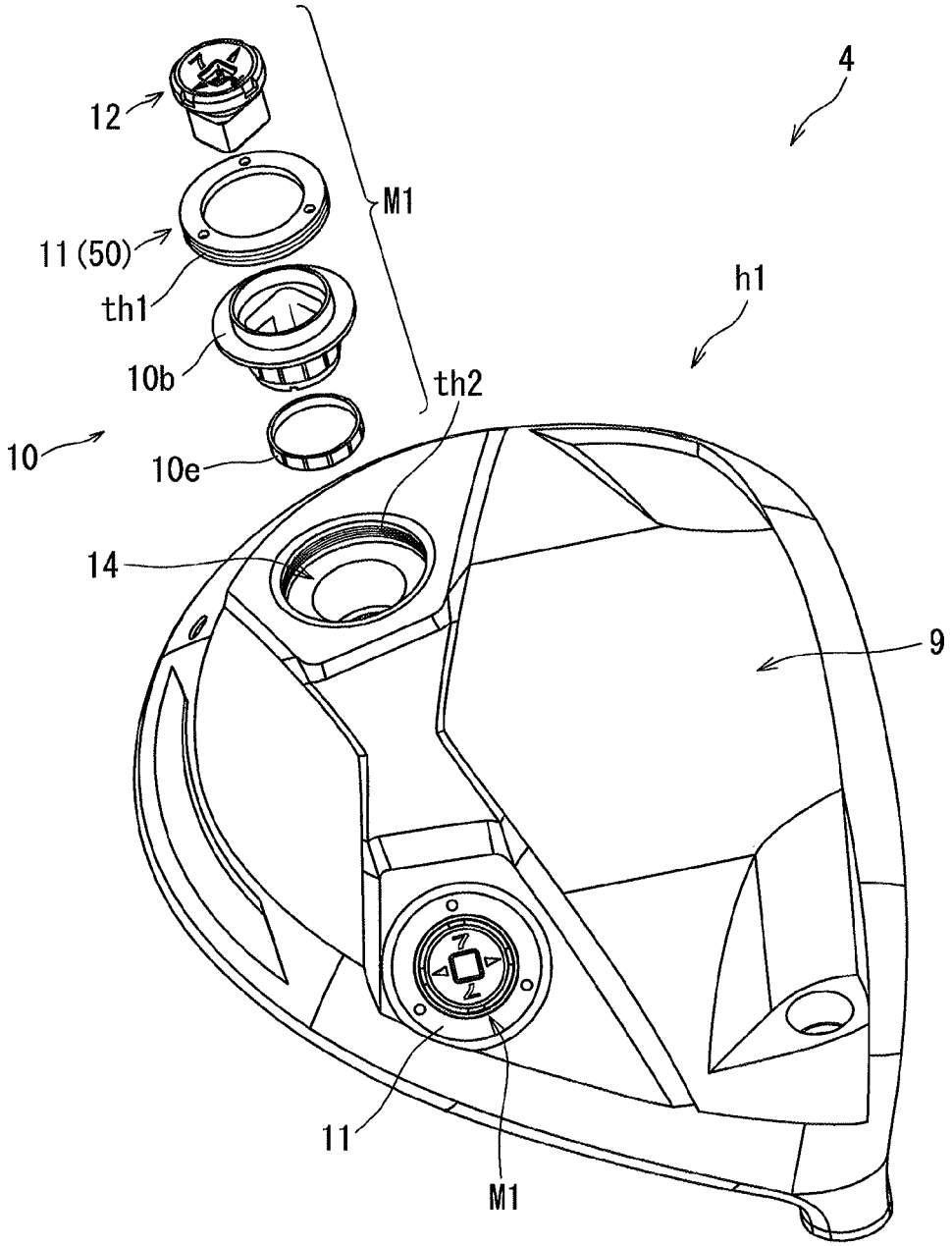
FIG. 2 is a perspective view of the head in FIG. 1, and includes an exploded perspective view of a weight body attaching/detaching mechanism.

FIG. 2 is a perspective view of the head 4 viewed from the sole 9 side. The head 4 includes a head main body h1 and a weight body attaching/detaching mechanism M1. The head 4 includes a plurality of (two) weight body attaching/detaching mechanisms M1. FIG. 2 includes an exploded perspective view of the weight body attaching/detaching mechanism M1. One of the two weight body attaching/detaching mechanisms M1 is illustrated in the exploded perspective view.

As illustrated in FIG. 2, the weight body attaching/detaching mechanism M1 includes a socket 10, an attachment member 11, and a weight body 12. The head main body h1 includes a socket housing portion 14. The inner shape of the socket housing portion 14 corresponds to the outer shape of the socket 10. The number of the socket housing portions 14 is the same as the number of the weight body attaching/detaching mechanism M1. The number of the socket housing portions 14 is the same as the number of the sockets 10. In the embodiment, two socket housing portions 14 are provided. The number of the socket housing portions 14 may be one, two, or three or more than three. The number of the weight body attaching/detaching mechanism M1 may be one, two, or three or more than three.

Figure 3:
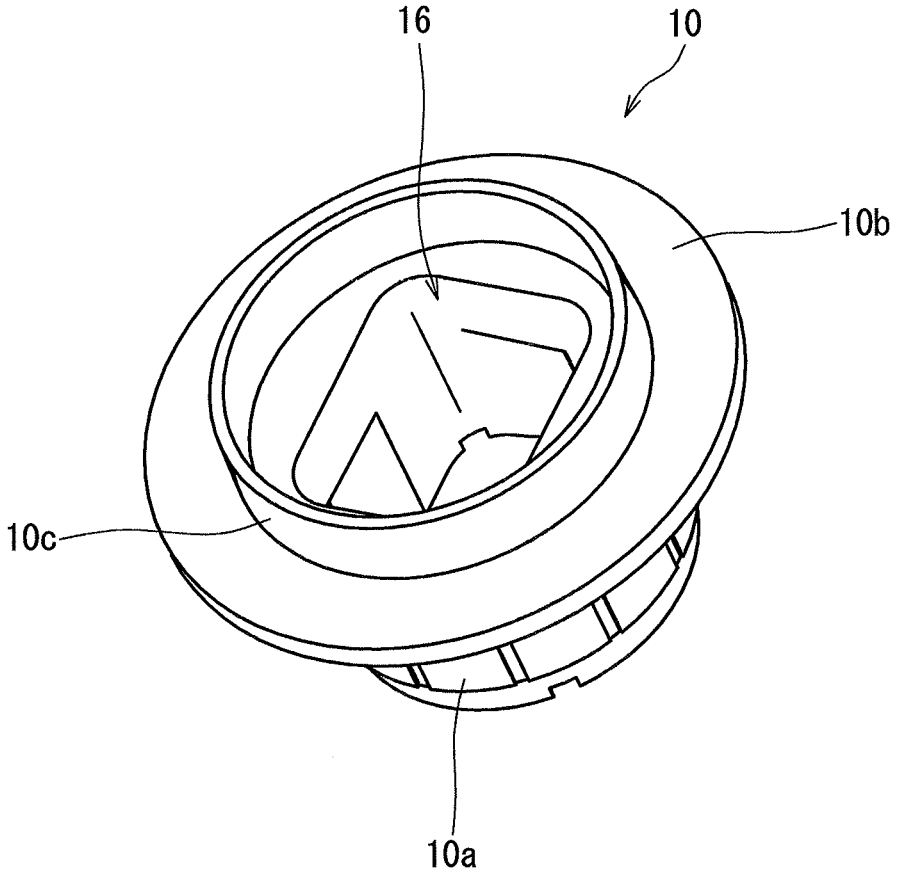
FIG. 3 is a perspective view of a socket.
Figure 4A:
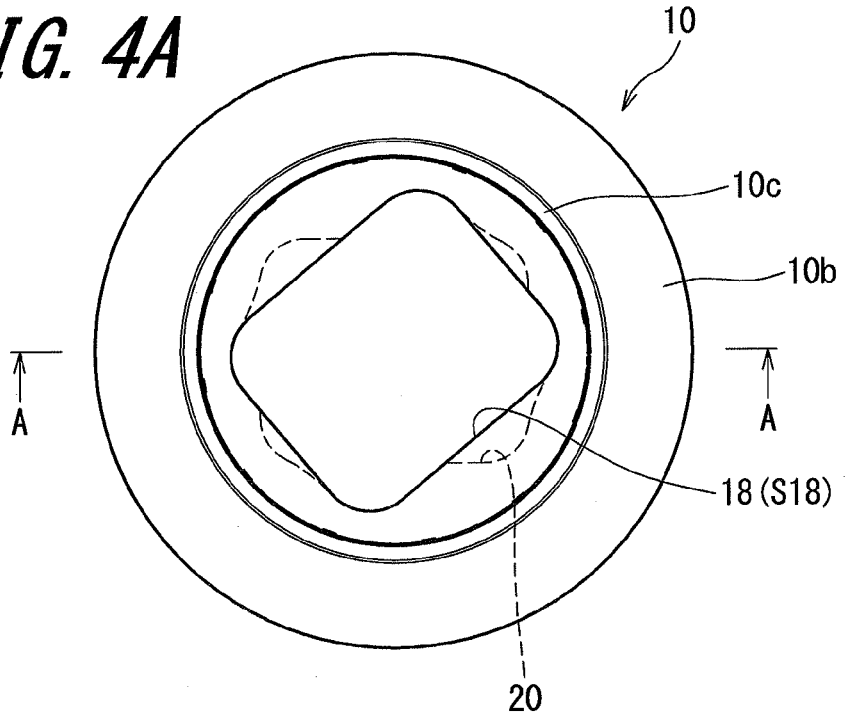
FIG. 4A is a plan view of a socket and FIG. 4B is a bottom view of the socket.
Figure 4B:
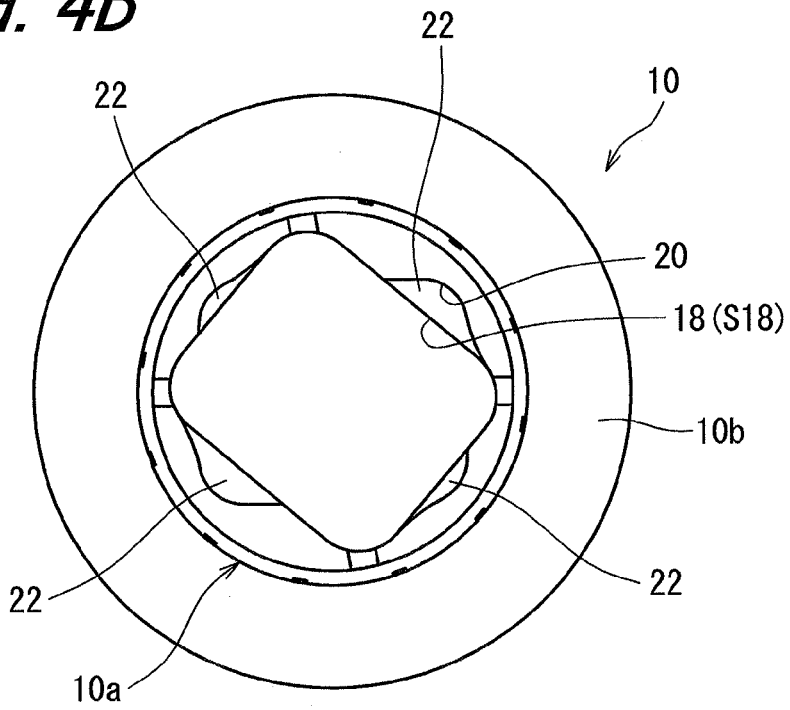
Figure 5:
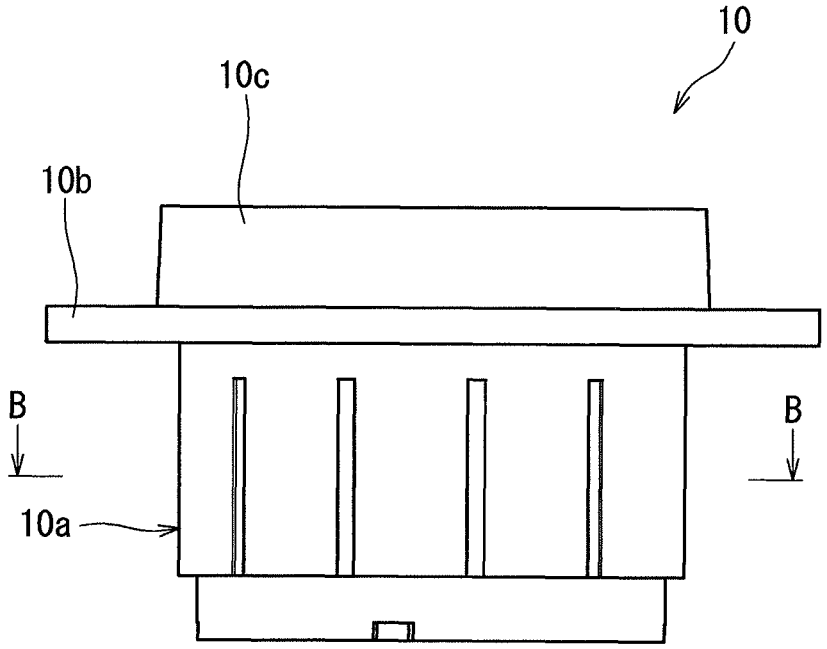
FIG. 5 is a side view of the socket.
Figure 6:
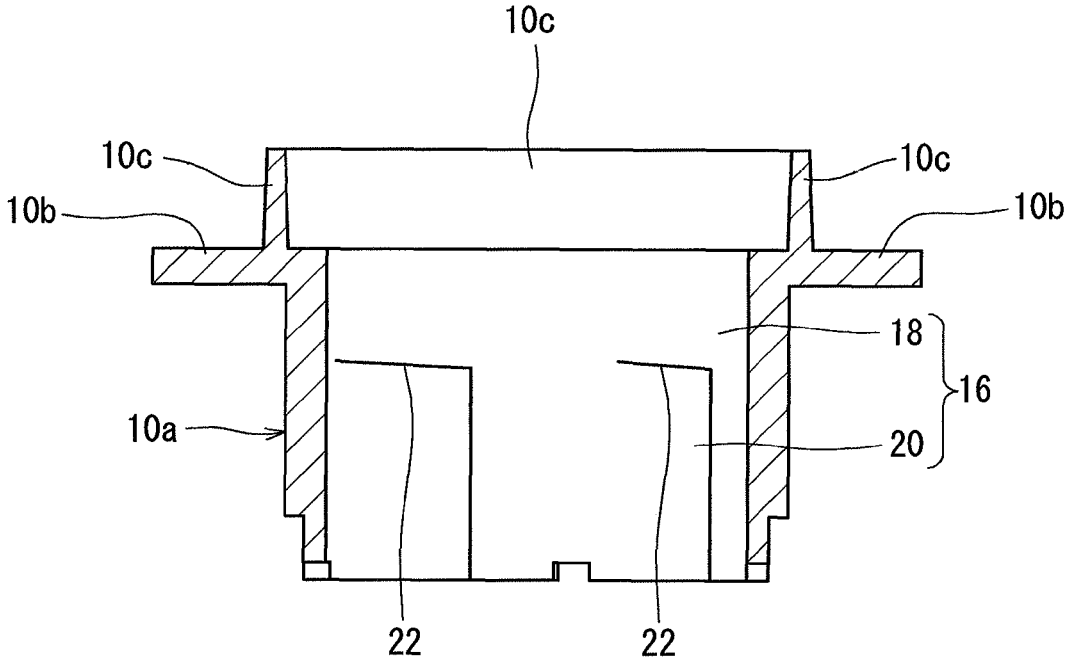
FIG. 6 is a cross-sectional view taken along line A-A in FIG. 4A.
Figure 7:
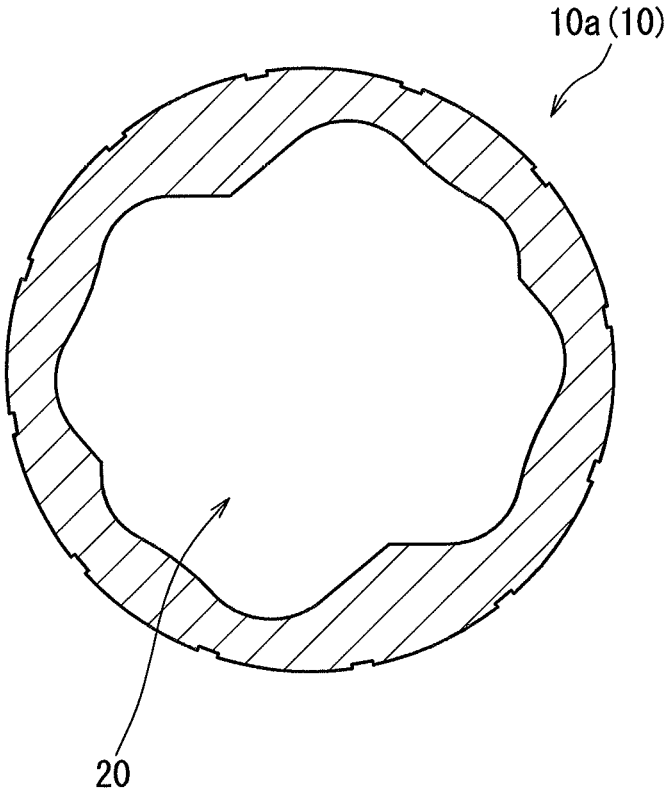
FIG. 7 is a cross-sectional view taken along line B-B in FIG. 5.

FIG. 3 is a perspective view of the socket 10. FIG. 4A is a plan view of the socket 10. FIG. 4B is a bottom view of the socket 10. FIG. 5 is a side view of the socket 10. FIG. 6 is a cross-sectional view taken along line A-A in FIG. 4. FIG. 7 is a cross-sectional view taken along line B-B in FIG. 5.

The socket 10 is fixed to the inner side of the socket housing portion 14. The fixing is attained using an adhesive, for example. The socket 10 may not be fixed using an adhesive. The socket 10 may be fixed by being held between the attachment member 11 and the head main body h1. The socket 10 may be fixed only by being held between the attachment member 11 and the head main body h1.

The socket 10 includes a main body portion 10*a*, a held portion 10*b*, and an intermediate portion 10*c*. The main body portion 10*a* includes a hole 16. The hole 16 extends through the main body portion 10*a*.

The held portion 10*b* is in a flange shape. The held portion 10*b* is in an annular shape. The held portion 10*b* extends from the main body portion 10*a* to the outer side in an axial perpendicular direction. The axial perpendicular direction means a direction perpendicular to a rotation axis line Z of the weight body 12. The held portion 10*b* is positioned on the upper end portion of the main body portion 10*a*. The held portion 10*b* is positioned between the head main body h1 and the attachment member 11. The held portion 10*b* is positioned between the socket housing portion 14 and the attachment member 11.

The intermediate portion 10*c* is in a tubular shape. The intermediate portion 10*c* extends in the axial direction. The axial direction means the direction of the axis line Z. The center axial line of the intermediate portion 10*c* is matched with the axis line Z. As illustrated in FIG. 6, the intermediate portion 10*c* extends upwardly from the top end of the main body portion 10*a*. The top end of the intermediate portion 10*c* is a free end. The inner diameter of the intermediate portion 10*c* is set so as to pass the weight body 12 through the intermediate portion 10*c*. The weight body 12 can be inserted into the socket 10 through the intermediate portion 10*c*.

The intermediate portion 10*c* is provided throughout in the circumferential direction. The intermediate portion 10*c* may be intermittently provided in the circumferential direction. The effect, described later, can be exerted even when the intermittent intermediate portion 10*c* is provided.

The weight body 12 is detachably attached to the socket 10. Therefore, the weight body 12 is detachably attached to the head 4. The position of the center of gravity of the head can be changed by replacing the weight body 12. The weight of the head can be changed by replacing the weight body 12.

As illustrated in FIG. 6, the hole 16 includes a first hole portion 18, a second hole portion 20, and a step surface 22. The second hole portion 20 is positioned on the deeper side (the lower side) of the first hole portion 18. The entire inner surface of the first hole portion 18 smoothly continues. In the embodiment, the cross-sectional shape of the inner surface of the first hole portion 18 is in a substantially rectangular shape (see FIGS. 4A and 4B). The substantially rectangular shape is a rectangular shape with four rounded corners. The cross-sectional shape of the inner surface of the first hole portion 18 is substantially the same as the cross-sectional shape of an engaging portion 32 of the weight body 12.

As illustrated in FIG. 7, the cross-sectional shape of the inner surface of the second hole portion 20 includes complicated unevenness. The detail of the cross-sectional shape will be described later.

The cross-sectional shape of the first hole portion 18 is different from the cross-sectional shape of the second hole portion 20. The step surface 22 is formed due to the difference (see FIG. 4B). The step surface 22 is a downward surface.

As illustrated in FIG. 2, the socket 10 includes a bottom face forming part 10*e*. The bottom face forming part 10*e* forms the bottom part of the socket 10. The bottom face forming part 10*e* blocks the lower opening of the second hole portion 20. The bottom face forming part 10*e* can prevent the weight body 12 from contacting the bottom portion of the socket housing portion 14. It is noted that the bottom face forming part 10*e* may not be included. The bottom face forming part 10*e* may be integrally formed with the other parts of the socket 10.

The socket 10 is formed of a polymer. An elastic modulus Es of the polymer is lower than an elastic modulus Eh of a material forming the head main body h1. Preferably, the material of the socket 10 is a resin. The second hole portion 20 of the socket 10 can be elastically deformed in association with rotation of the weight body 12. The detail of the elastic deformation will be described later.

Figure 8:
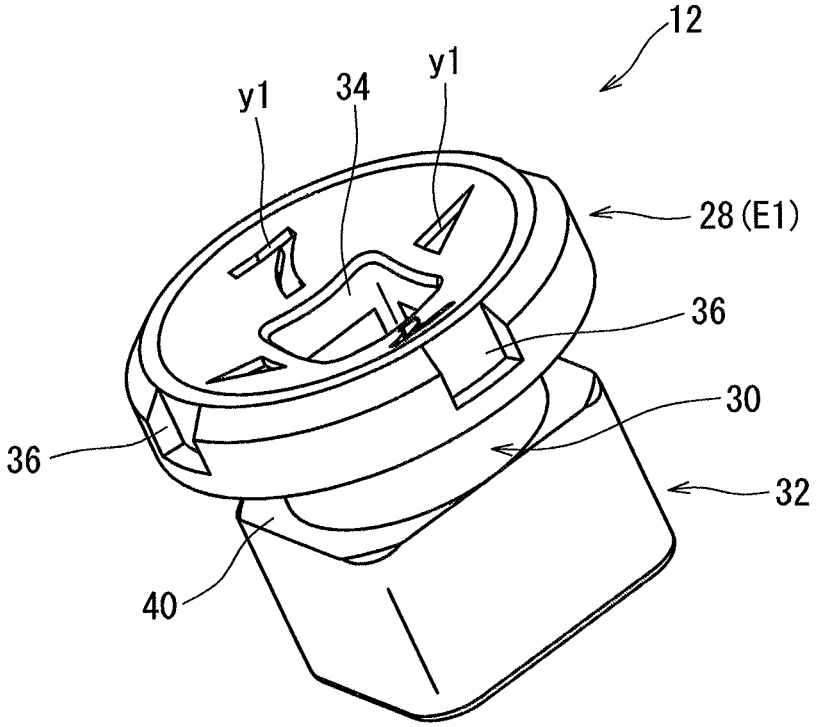
FIG. 8 is a perspective view of a weight body.
Figure 9A:
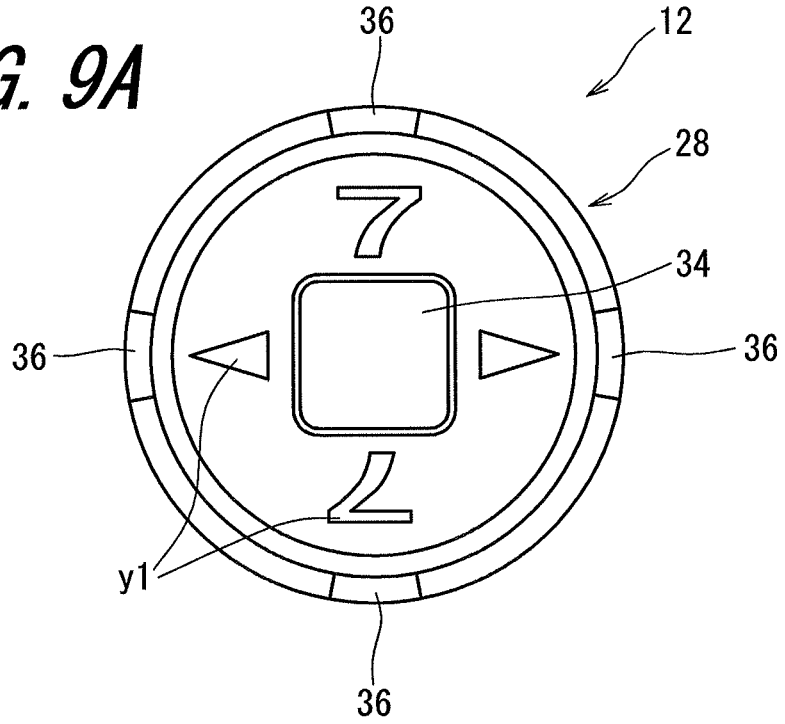
FIG. 9A is a plan view of the weight body and FIG. 9B is a bottom view of the weight body.
Figure 9B:
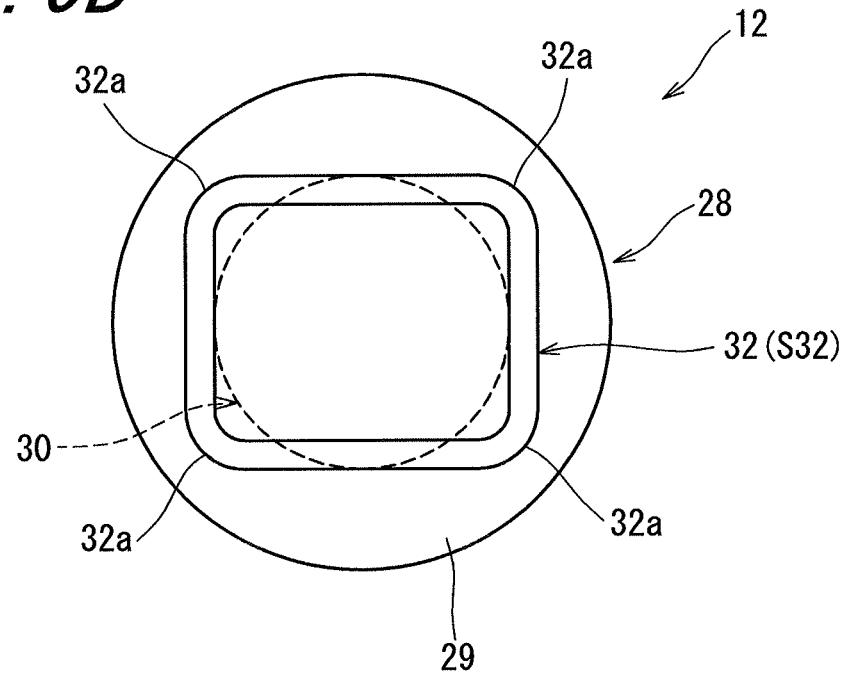
Figure 10A:
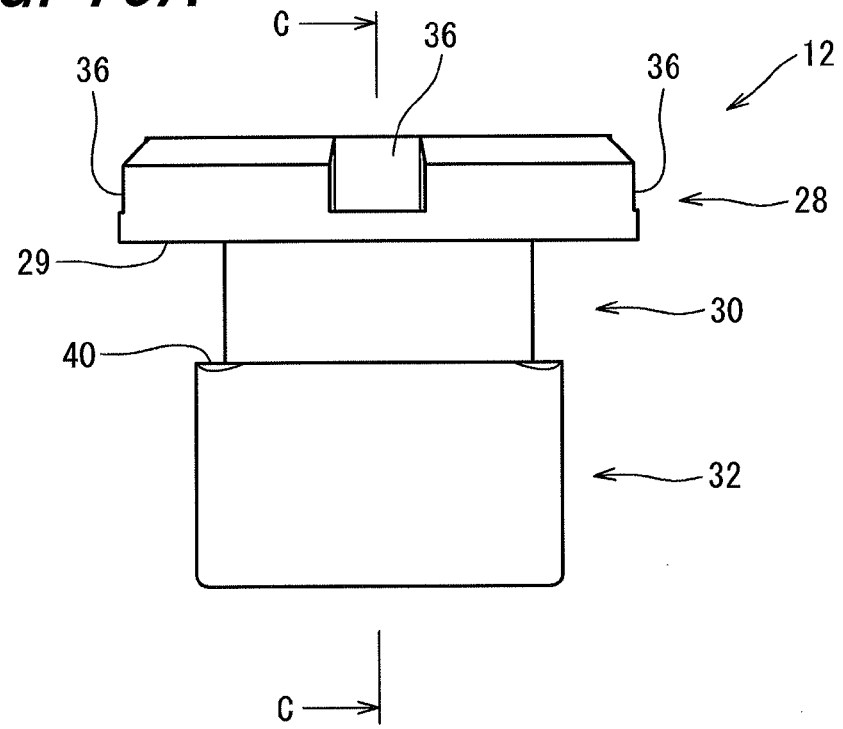
FIGS. 10A and 10B are side views of the weight body.
Figure 10B:
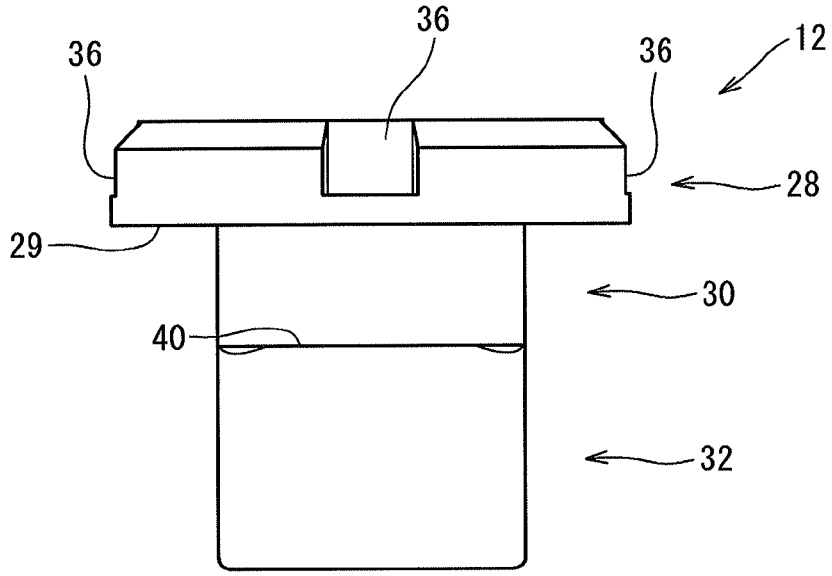
Figure 11:
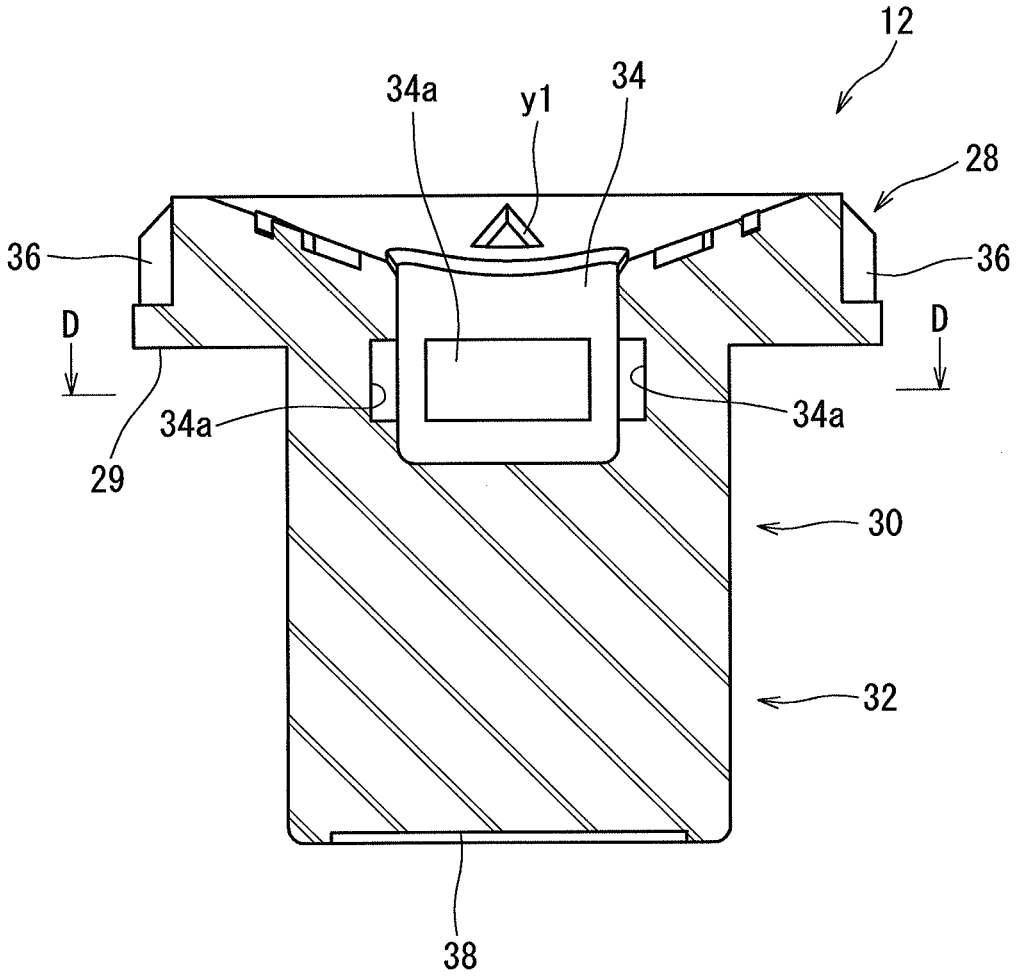
FIG. 11 is a cross-sectional view taken along line C-C in FIG. 10A.
Figure 12:
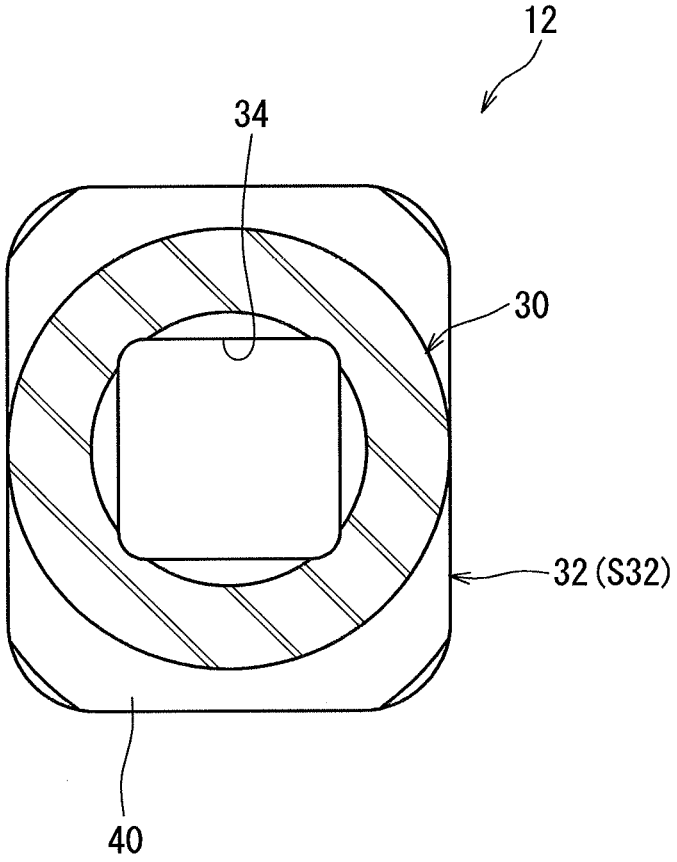
FIG. 12 is a cross-sectional view taken along line D-D in FIG. 11.

FIG. 8 is a perspective view of the weight body 12. FIG. 9A is a plan view of the weight body 12. FIG. 9B is a bottom view of the weight body 12. FIGS. 10A and 10B are side views of the weight body 12. The view point is different between FIG. 10A and FIG. 10B at an angle of 90°. FIG. 11 is a cross-sectional view taken along line C-C in FIG. 10A. FIG. 12 is a cross-sectional view taken along line D-D in FIG. 11.

As illustrated in FIGS. 8, 10A, and 10B, the weight body 12 includes a head portion 28, a neck portion 30, and the engaging portion 32. A noncircular hole 34 is formed at the center of the upper end face of the head portion 28. In the embodiment, the shape of the noncircular hole 34 is in a substantially quadrilateral shape. A recess 34*a* is provided on the inner surface of the noncircular hole 34 (see FIG. 11). A plurality of cutouts 36 is formed on the outer circumferential surface of the head portion 28. The outer surface of the neck portion 30 is a circumferential surface. The neck portion 30 is in a cylindrical shape. The top surface of the head portion 28 is externally exposed as fixed to the socket 10.

The outer surface of the engaging portion 32 has a noncircular cross-sectional shape S32. As illustrated in FIGS. 9B and 12, in the embodiment, the cross-sectional shape S32 is in a substantially rectangular shape. The cross-sectional shape S32 of the engaging portion 32 and a cross-sectional shape S18 of the first hole portion 18 are in the similar relationship (see FIG. 4B). The cross-sectional shape S32 of the engaging portion 32 is (slightly) smaller than the sectional shape S18. The engaging portion 32 can be inserted into the first hole portion 18.

As illustrated in FIG. 11, a recess 38 is formed on the lower end face of the engaging portion 32. The volume of the weight body 12 can be adjusted by the volume of a space formed by the recess 38 without changing the outer shape of a portion engaged with the socket 10. Therefore, the mass of the weight body 12 can be easily adjusted.

As illustrated in FIG. 9B, the engaging portion 32 includes a corner 32*a*. A plurality of corners 32*a* is provided. In the embodiment, four corners 32*a* are provided. The corner 32*a* forms a protruding portion that protrudes in the axial perpendicular direction.

The engaging portion 32 includes an engaging surface 40 (see FIGS. 8, 10A, and 12). The engaging surface 40 is formed due to the difference between the cross-sectional shapes of the engaging portion 32 and the neck portion 30. The engaging surface 40 is an upward surface. The engaging surface 40 is opposed to a lower surface 29 of the head portion 28.

A specific gravity G4 of the weight body 12 is greater than a specific gravity G1 of the head main body h1. The specific gravity G4 of the weight body 12 is greater than a specific gravity G3 of the socket 10. From the viewpoint of durability and specific gravity, preferably, the material of the weight body 12 is a metal. The metal includes aluminum, an aluminum alloy, titanium, a titanium alloy, stainless steel, a tungsten alloy, and a tungsten nickel alloy (W—Ni alloy). An example of the titanium alloy is a 6-4Ti (Ti-6Al-4V) alloy. An example of stainless steel is *SUS*304 steel.

A method of manufacture of the weight body 12 is forging, casting, sintering, and NC processing, for, example. Preferably, in the case of an aluminium alloy, a 6-4Ti alloy, and SUS304 steel, NC processing is preferably performed after casting. NC stands for "Numerical Control".

Figure 13:
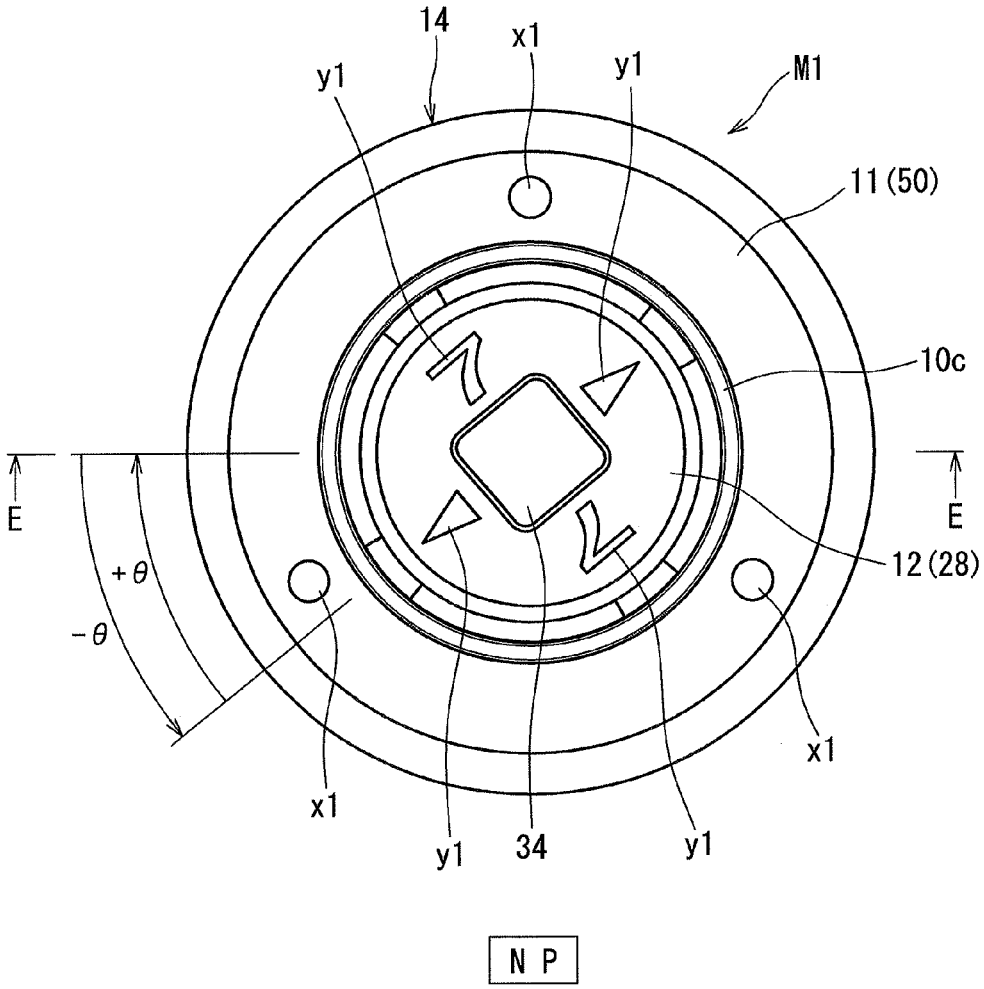
FIG. 13 is a plan view of the weight body attaching/detaching mechanism attached to a socket housing portion, and is a view at a non-engaging position NP.
Figure 14:
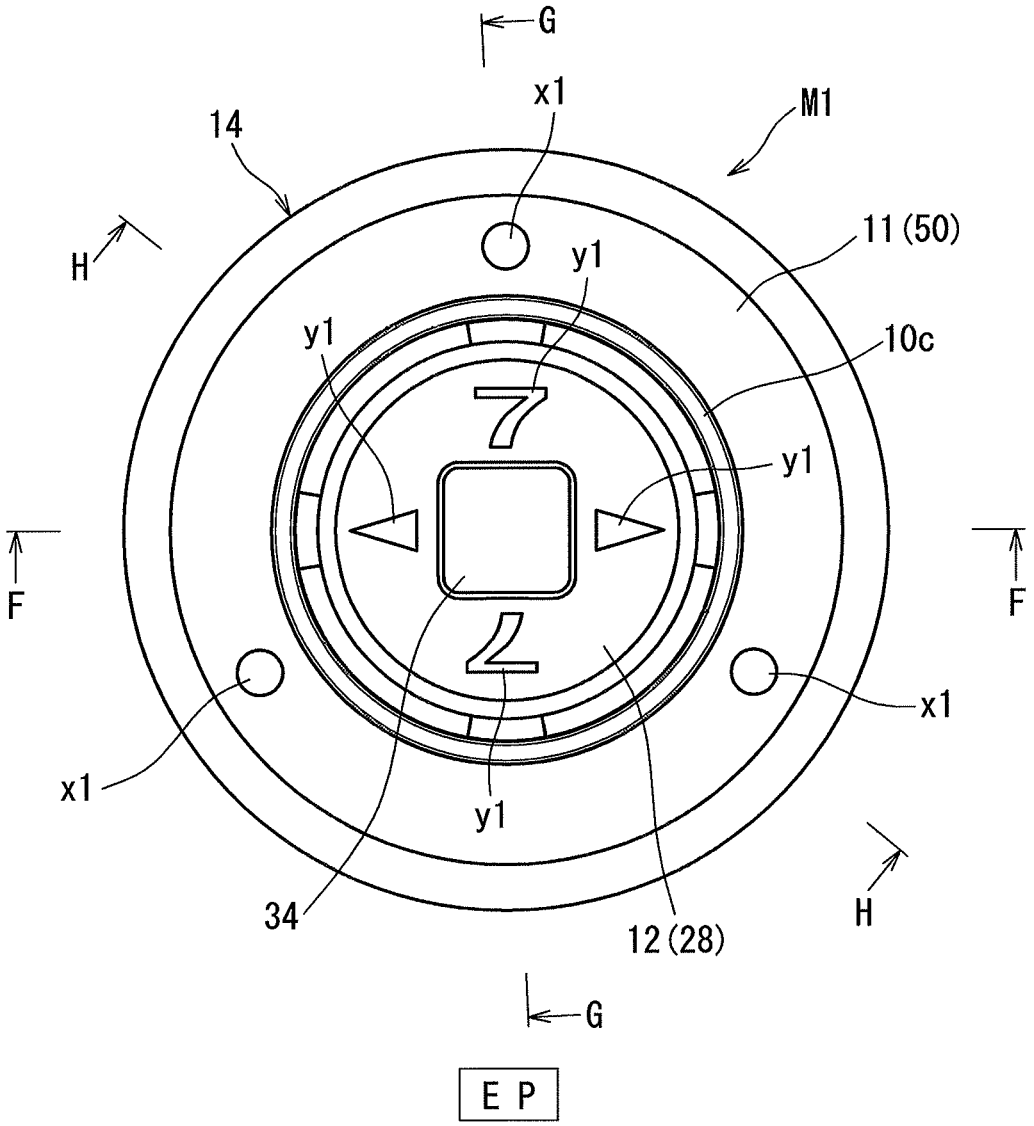
FIG. 14 is a plan view of the weight body attaching/detaching mechanism attached to the socket housing portion, and is a view at an engaging position EP.

FIG. 13 is a plan view of the weight body attaching/detaching mechanism M1 at a non-engaging position NP. FIG. 14 is a plan view of the weight body attaching/detaching mechanism M1 at an engaging position EP.

The weight body 12 can be rotated with respect to the socket 10. With the relative rotation, the weight body 12 can be placed at the non-engaging position NP and the engaging position EP.

At the non-engaging position NP, the weight body 12 can be pulled out of the socket 10. At the non-engaging position NP, the weight body 12 is in an unlocked state.

In contrast to this, at the engaging position EP, the weight body 12 cannot be pulled out of the socket 10. At the engaging position EP, the weight body 12 is fixed to the socket 10. At the engaging position EP, the weight body 12 is in a locked state. When the club 2 is being used, the weight body 12 is set at the engaging position EP. The weight body 12 in the locked state does not fall off.

At the time point at which the weight body 12 is inserted into the socket 10, the weight body 12 is at the non-engaging position NP with respect to the socket 10. By the relative rotation at an angle of θ, the position of the weight body 12 is changed from the non-engaging position NP to the engaging position EP. By the reverse relative rotation at the angle of θ, the position of the weight body 12 is returned from the engaging position EP to the non-engaging position NP. An angle of the relative rotation changed from the non-engaging position NP to the engaging position EP is also noted as "+θ" in the present application. An angle of the relative rotation changed from the engaging position EP to the non-engaging position NP is noted as "−θ" in the present application. The reference signs "+" and "−" are noted in order to express that the rotation directions are opposite to each other.

In the weight body attaching/detaching mechanism M1, the weight body 12 can be attached and detached only by rotating the weight body 12 at the angle of θ. The weight body attaching/detaching mechanism M1 is excellent in the ease of attachment and detachment.

In the embodiment, the angle of θ is 40°. The angle of θ is not limited to 40°. From the viewpoint of reliability of fixing, the angle of θ is preferably equal to or greater than a 20°, and more preferably equal to or greater than 30°. From the viewpoint of the ease of attachment and detachment, the angle of θ is preferably equal to or less than 60°, and more preferably equal to or less than 50°.

Figure 15A:
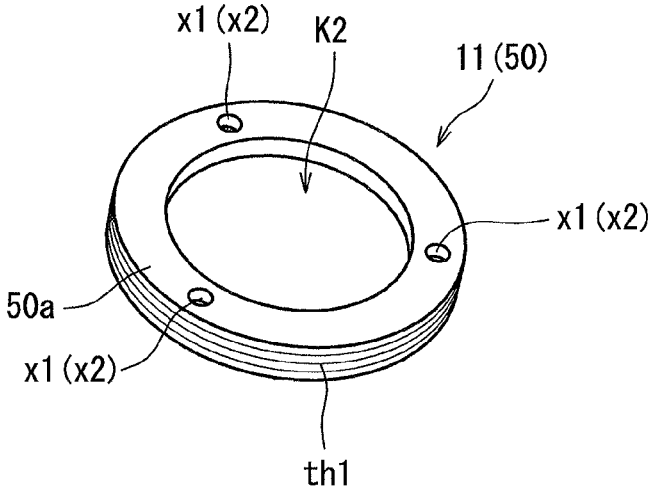
FIG. 15A is a perspective view of a ring member.
Figure 15B:
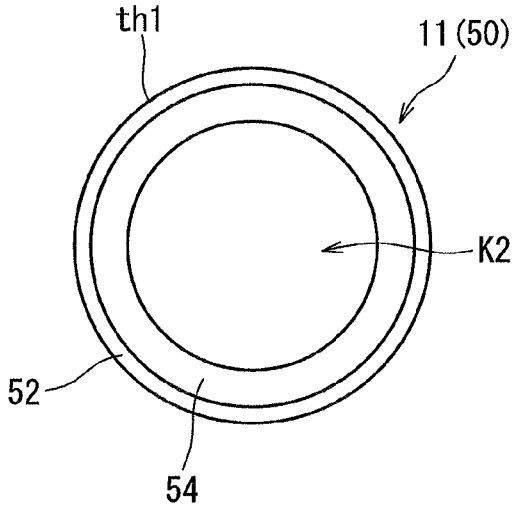
FIG. 15B is a bottom view of the ring member.
Figure 15C:
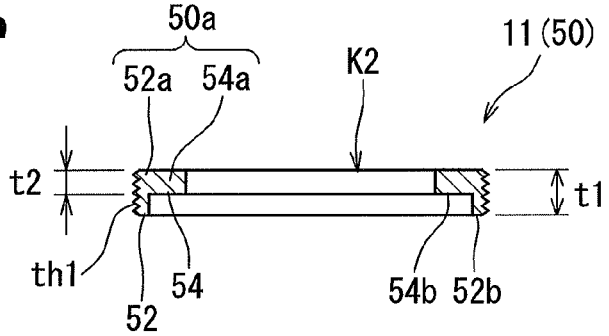
FIG. 15C is a cross-sectional view of the ring member.

FIG. 15A is a perspective view of the attachment member 11. FIG. 15B is a bottom view of the attachment member 11. FIG. 15C is a cross-sectional view of the attachment member 11. It is noted that FIGS. 13 and 14 include a plan view of the attachment member 11.

In the embodiment, the attachment member 11 is a ring member 50. The ring member 50 includes an opening K2. In order to distinguish from the other openings, the opening K2 is also referred to as a second opening. The second opening K2 extends through the ring member 50. The weight body 12 can be inserted into the socket 10 through the second opening K2. The inner diameter of the ring member 50 is set in such a way that the weight body 12 can be inserted into the socket 10 through the second opening K2.

As illustrated in FIG. 15B, the ring member 50 includes an outer circumferential portion 52 and an inner circumferential portion 54. As illustrated in FIG. 15C, a thickness t1 of the outer circumferential portion 52 is greater than a thickness t2 of the inner circumferential portion 54.

As illustrated in FIG. 15C, a top surface 52*a* of the outer circumferential portion 52 is flush with a top surface 54*a* of the inner circumferential portion 54. The top surface 50*a* of the ring member 50 is formed of the top surface 52*a* and the top surface 54*a*. On the other hand, a lower surface 52*b* of the outer circumferential portion 52 is not flush with a lower surface 54*b* of the inner circumferential portion 54. The lower surface 54*b* is positioned on the upper side of the lower surface 52*b*.

As illustrated in FIG. 15A, the ring member 50 includes an indication x1. The indication x1 is provided on the top surface 50*a* of the ring member 50. In the state in which the ring member 50 is attached to the head 4, the indication x1 can be visually recognized. The ring member 50 includes a plurality of indications x1 (in the embodiment, three indications x1). The indications x1 are disposed in the circumferential direction of the ring member 50 at regular intervals.

In the embodiment, the indication x1 is a recess. Thus, the indication x1 may be three-dimensionally formed. A three-dimensional indication x1 includes a recess and a projection. The indication x1 may not be in a three-dimensional shape. For example, the indication x1 can be formed by making the color different from the colors of the surrounding portions by coating, for example. It is fine that the indication x1 is visually recognized.

The indication x1 is useful to determine the position of the weight body 12. As understood from the comparison between FIG. 13 and FIG. 14, the indication x1 facilitates the determination whether the weight body 12 is at the engaging position EP.

As illustrated in FIG. 15A, the ring member 50 includes a rotation engaging portion x2. The engaging portion x2 is provided on the top surface 50*a* of the ring member 50. In the state in which the ring member 50 is attached to the head 4, the engaging portion x2 is exposed. A tool for rotating the ring member 50 can be engaged with the engaging portion x2. The engaging portion x2 makes the rotation of the ring member 50 easy when the ring member 50 is screwed. In the embodiment, the engaging portion x2 also serves as the indication x1.

The ring member 50 includes a plurality of engaging portions x2 (in the embodiment, three engaging portions). The engaging portions x2 make the rotation of the ring member 50 easy. The engaging portions x2 are disposed at regular intervals in the circumferential direction of the ring member 50. Thus, the torque for rotating the ring member 50 can be uniformly applied in the circumferential direction.

In the embodiment, the engaging portion x2 is a recess. The recess may be a groove. The recess attains a reduction in the weight of the ring member 50. It is noted that the engaging portion x2 is not limited to a recess. The engaging portion x2 may be a projection, for example.

The weight body 12 includes an indication y1 . As illustrated in FIGS. 13 and 14, in the embodiment, a plurality of (four) indications y1 is provided. In the embodiment, the indication y1 is a numerical character and a mark. The positional relationship between the indication y1 and the indication x1 further facilitates the determination whether the weight body 12 is at the engaging position EP.

The indication y1 includes a numerical character expressing the mass of the weight body 12. In the embodiment, the indication y1 includes the numerical character, "7". The weight body 12 has seven grams.

As illustrated in FIG. 8, in the embodiment, the indication y1 is a recess. Thus, the indication y1 may be three-dimensionally formed. A three-dimensional indication y1 includes a recess and a projection. Moreover, the indication y1 may not be in a three-dimensional shape. For example, the indication y1 can be formed by making the color different from the colors of the surrounding portions by coating, for example. It is fine that the indication y1 is visually recognized.

A screw thread th1 is formed on the ring member 50. The screw thread th 1 is formed on the outer circumferential surface of the ring member 50. The screw thread th1 is a male thread.

Figure 16:
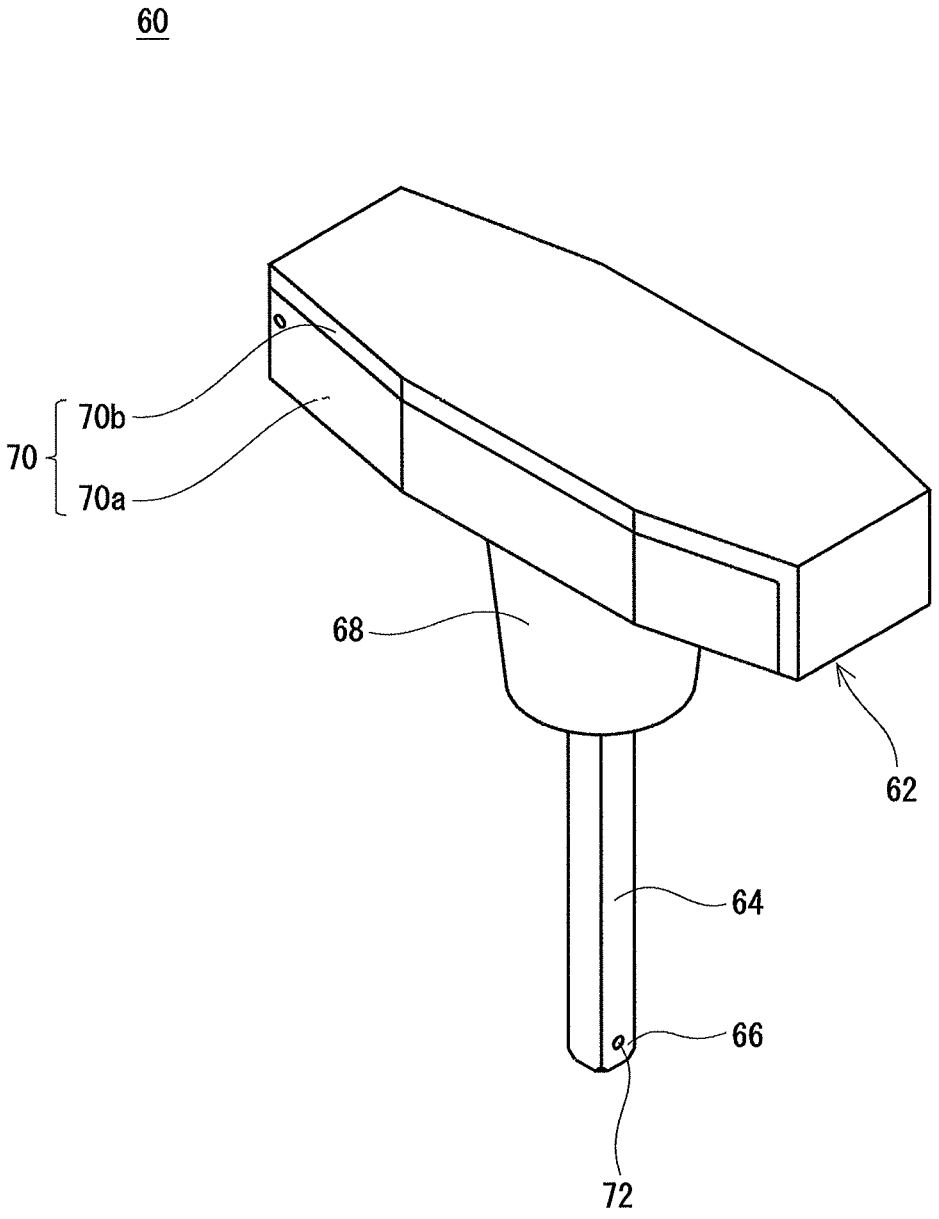
FIG. 16 is a perspective view of a tool for rotating the weight body.

A dedicated tool may be used for rotating the weight body 12. FIG. 16 is a perspective view of an example of a tool 60. The tool 60 includes a handle 62, a shaft 64, and a tip end portion 66. The handle 62 includes a handle body 68 and a holding part 70. The holding part 70 includes a holding part main body 70*a* and a lid 70*b*.

The rear end portion of the shaft 64 is fixed to the holding part main body 70*a*. The cross-sectional shape of the tip end portion 66 of the shaft 64 corresponds to the cross-sectional shape of the noncircular hole 34 of the weight body 12. In the embodiment, the cross-sectional shape of the tip end portion 66 is in a quadrilateral shape. A pin 72 is provided at the tip end portion 66. The pin 72 protrudes on the side surface of the tip end portion 66. Although not illustrated, an elastic body (a coil spring) is built in the tip end portion 66. The pin 72 is biased in the protruding direction by the biasing force of the elastic body.

When the weight body 12 is attached and detached, the lid 70*b* is closed. A weight body housing portion (not illustrated) is provided in the holding part main body 70*a*. Preferably, the weight body housing portion can house a plurality of weight bodies 12. Preferably, the weight bodies 12 with different weights are housed. The weight bodies 12 can be taken out by opening the lid 70*b*.

When the weight body 12 is attached, the tip end portion 66 of the tool 60 is inserted into the noncircular hole 34 of the weight body 12. The pin 72 presses the noncircular hole 34 while going backward according to the insertion. The weight body 12 is less likely to fall off from the tip end portion 66 due to the pressing force. The pin 72 can enter the recess 34*a* of the noncircular hole 34 (see FIG. 11). The weight body 12 is less likely to fall off from the tip end part 66 due to the entering of the pin 72. The weight body 12 held on the shaft 64 of the tool 60 is inserted into the hole 16.

The weight body 12 is inserted into the inner side of the attachment member 11 (the ring member 50), and reaches the socket 10. The weight body 12 is inserted into the inner side of the intermediate portion 10*c*, and reaches the hole 16.

The engaging portion 32 of the weight body 12 passes through the first hole portion 18 of the hole 16, and reaches the second hole portion 20. Immediately after the insertion, the weight body 12 is at the non-engaging position NP.

The weight body 12 at the non-engaging position NP is relatively rotated at an angle of +θ°. More specifically, the weight body 12 is rotated at an angle of +θ° with respect to the socket 10 using the tool 60. By the rotation, the position of the weight body 12 is changed from the non-engaging position NP to the engaging position EP. In this manner, the weight body 12 is completely attached. The weight body 12 is easily attached.

When the weight body 12 is detached, the weight body 12 is reversely rotated at the angle of θ°. That is, the weight body 12 is rotated at an angle of −θ°. By the rotation, the position of the weight body 12 is changed from the engaging position EP to the non-engaging position NP. The weight body 12 at the non-engaging position NP can be pulled out. As described above, the pin 72 can enter the recess 34*a* of the noncircular hole 34 (see FIG. 11). Due to the entering of the pin 72, the weight body 12 can be pulled out more easily.

At the engaging position EP, it is not possible to pull the weight body 12 out of the hole 16. At the engaging position EP, the engagement between the step surface 22 of the hole 16 and the engaging surface 40 of the weight body 12 inhibits the pulling out of the weight body 12. At the engaging position EP, the tool 60 can be easily pulled out of the noncircular hole 34 of the weight body 12.

Figure 17:
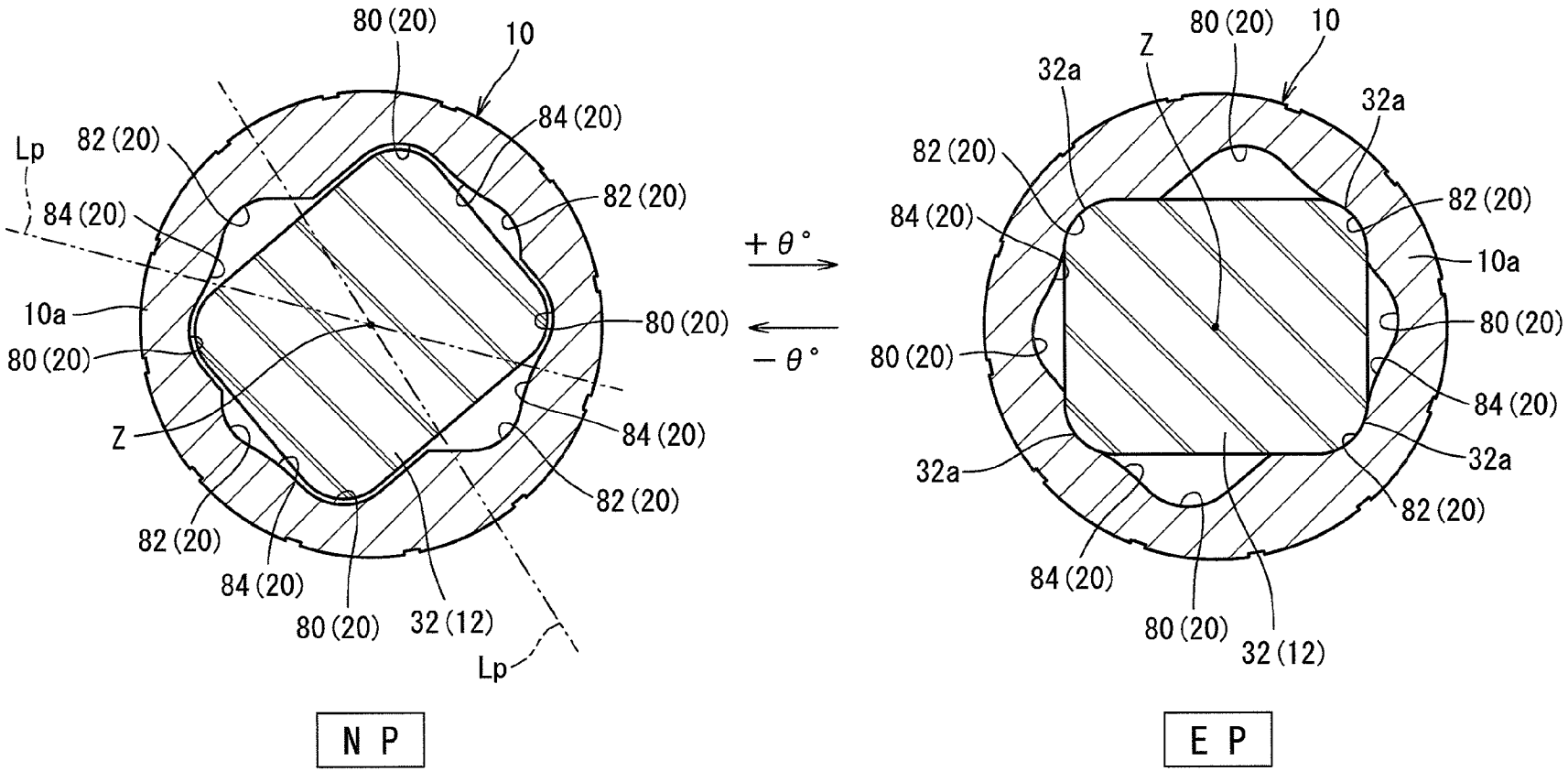
FIG. 17 is a cross-sectional view of a second hole and an engaging portion, illustrating the non-engaging position NP and the engaging position EP.

FIG. 17 is cross-sectional views of the engaging portion 32 and the socket 10. A cross-sectional view at the non-engaging position NP is illustrated on the left side in FIG. 17. A cross-sectional view at the engaging position EP is illustrated on the right side in FIG. 17. The axis line Z, which is the center axis of rotation at the angle of θ°, is illustrated by a point in FIG. 17. The center of the cross section of the outline of the engaging portion 32 in the drawing is located on the axis line Z. The rotation of the weight body 12 in the relative rotation is rotation about the axis line Z.

As illustrated in FIG. 17, the second hole portion 20 of the socket 10 includes anon-engaging corresponding surface 80, an engaging corresponding surface 82, and a resistance surface 84. The non-engaging corresponding surface 80 is a surface corresponding to the engaging portion 32 at the non-engaging position NP. The engaging corresponding surface 82 is a surface corresponding to the engaging portion 32 at the engaging position EP. The resistance surface 84 is positioned between the non-engaging corresponding surface 80 and the engaging corresponding surface 82.

During the mutual transition between the non-engaging position NP and the engaging position EP, the resistance surface 84 is pressed by the engaging portion 32. The press is mainly made by the corner 32*a*. The press causes frictional force between the engaging portion 32 and the second hole portion 20. The press elastically deforms the resistance surface 84. The frictional force is changed based on the elastic modulus Es of the socket 10. The frictional force causes rotational resistance. A great frictional force causes a great rotational resistance. The elastic modulus Es is increased, so that the rotational resistance can be increased. Because of a great rotational resistance, a strong torque is necessary for the mutual transition between the non-engaging position NP and the engaging position EP. In this case, the mutual transition does not easily take place. The transition from the engaging position EP to the non-engaging position NP is not caused by the impact force when hitting a ball. The tool 60 is necessary to the mutual transition. It is not possible to attain the mutual transition with hands with no use of the tool 60. The weight body 12 at the engaging position EP does not fall off even by a strong impact when hitting a ball.

In the case where the elastic modulus Es is too large, an excessive torque is sometimes necessary to attain the mutual transition. From the viewpoint of the ease of attachment, an excessive torque is not preferable. The elastic modulus Es is set in such a way that the torque necessary to the mutual transition becomes appropriate.

In the mutual transition, the torque necessary to rotate the weight body 12 becomes the maximum when the resistance surface 84 is elastically deformed. The torque necessary to rotate the weight body 12 becomes the maximum during the mutual transition. Thus, the transition from the engaging position EP to the non-engaging position NP does not easily take place. The local maximum torque contributes to the prevention of falling off the weight body 12 during play.

As illustrated in FIG. 17, the resistance surface 84 includes a projecting portion. The projecting portion is formed of a smooth curved surface. The projecting portion increases the rotational resistance caused during the mutual transition. The projecting portion can effectively suppress the release from the engaging position EP.

Thus, in the weight body attaching/detaching mechanism M1, the weight body 12 can be attached only by the relative rotation at the angle of θ. Moreover, the weight body 12 can be detached only by the relative rotation at the angle of θ.

At the non-engaging position NP, the engaging portion 32 does not deform the second hole portion 20. As illustrated in the left view in FIG. 17, at the non-engaging position NP, a gap can exist between the engaging portion 32 and the second hole portion 20. Thus, at the non-engaging position NP, the weight body 12 is easily inserted and pulled out. On the other hand, as illustrated in the right view in FIG. 17, at the engaging position EP, all the corners 32*a* are in intimate contact with the second hole portion 20 with no gap. In other words, at least a part of the corner 32*a* is a contact portion in all the corners 32*a*. The contact portion is a portion in intimate contact with the second hole portion 20 at the engaging position EP. As described above, the engaging portion 32 includes a plurality of contact portions. At the engaging position EP, the second hole portion 20 is expanded by the contact portions. The engaging corresponding surface 82 is pressed by the corner 32*a*, and the second hole portion 20 is elastically deformed by the press. The engaging corresponding surface 82 is elastically deformed. The elastic deformation expands the second hole portion 20. The elastic deformation increases the distance between two engaging corresponding surfaces 82 opposite to each other. The dimensions of the engaging portion 32 and the dimensions of the second hole portion 20 are determined so as to allow the expansion. The weight body 12 is fixed by the restoring force of the elastic deformation.

As described above, in the weight body attaching/detaching mechanism M1, Configuration A and Configuration B below are attained. Configuration A further reliably provides the fixing of the weight body 12. Moreover, Configuration B facilitates attaching and detaching work.

[Configuration A] At the engaging position EP, the engaging portion 32 elastically deforms the socket 10, and the second hole portion 20 is expanded by the elastic deformation.

[Configuration B] At the non-engaging position NP, the engaging portion 32 does not elastically deform the socket 10.

Figure 18:
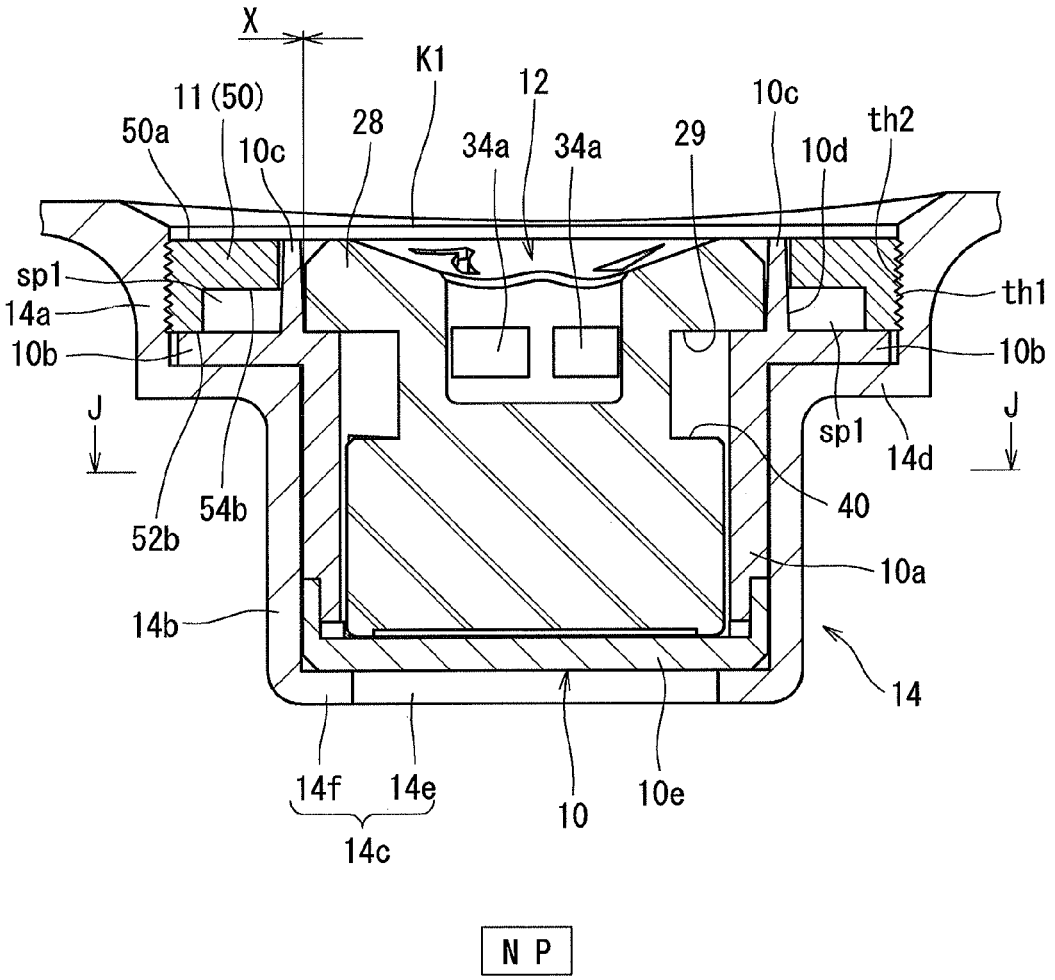
FIG. 18 is a cross-sectional view taken along line E-E in FIG. 13.
Figure 19:
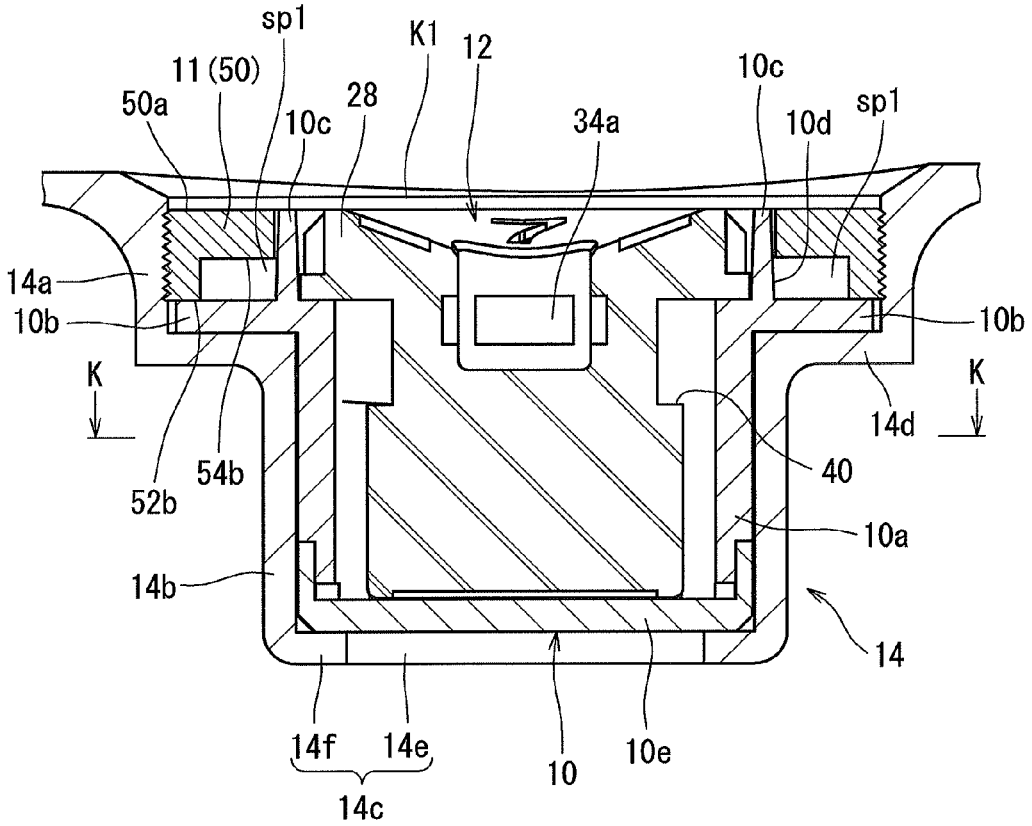
FIG. 19 is a cross-sectional view taken along line F-F in FIG. 14.
Figure 20:
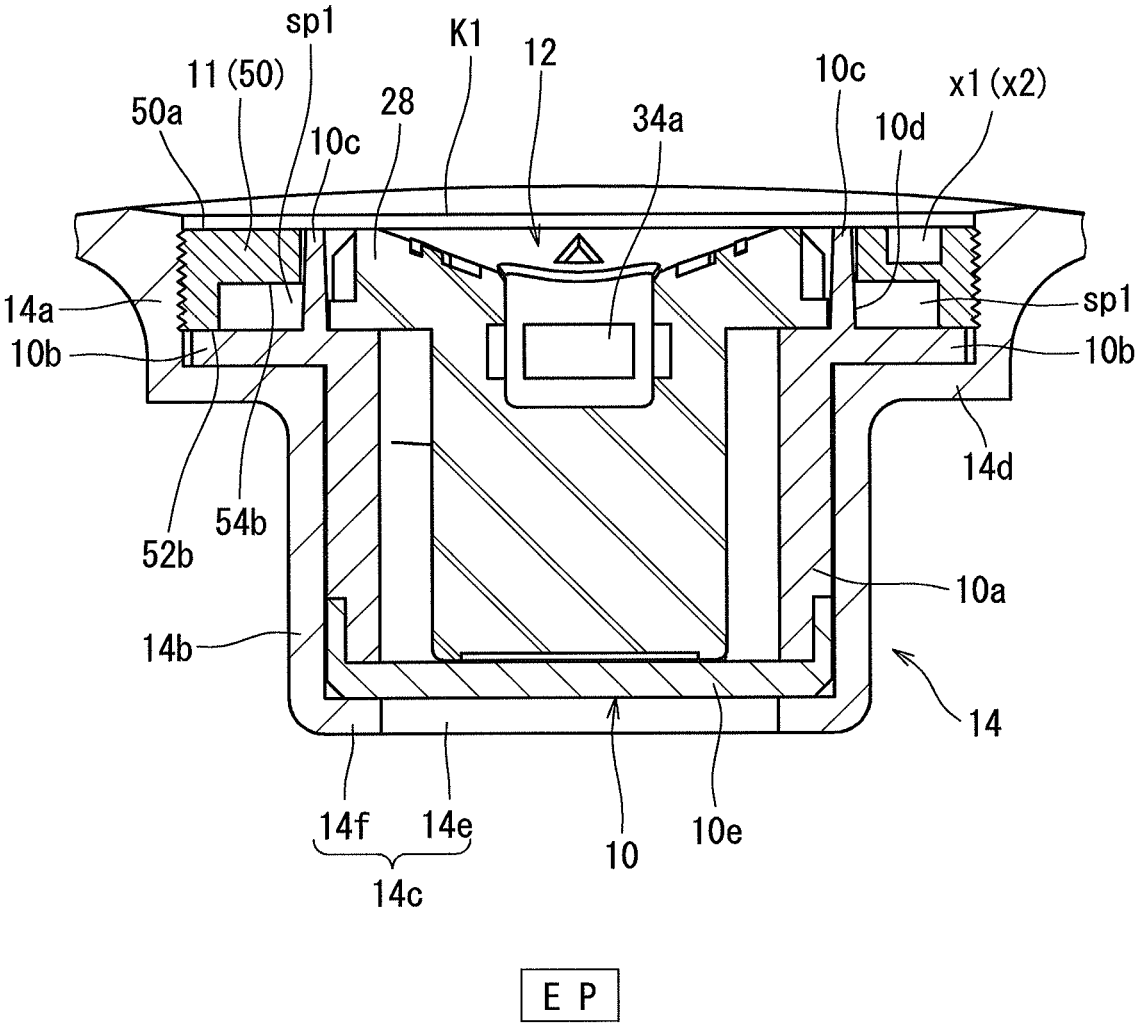
FIG. 20 is a cross-sectional view taken along line G-G in FIG. 14.
Figure 21:
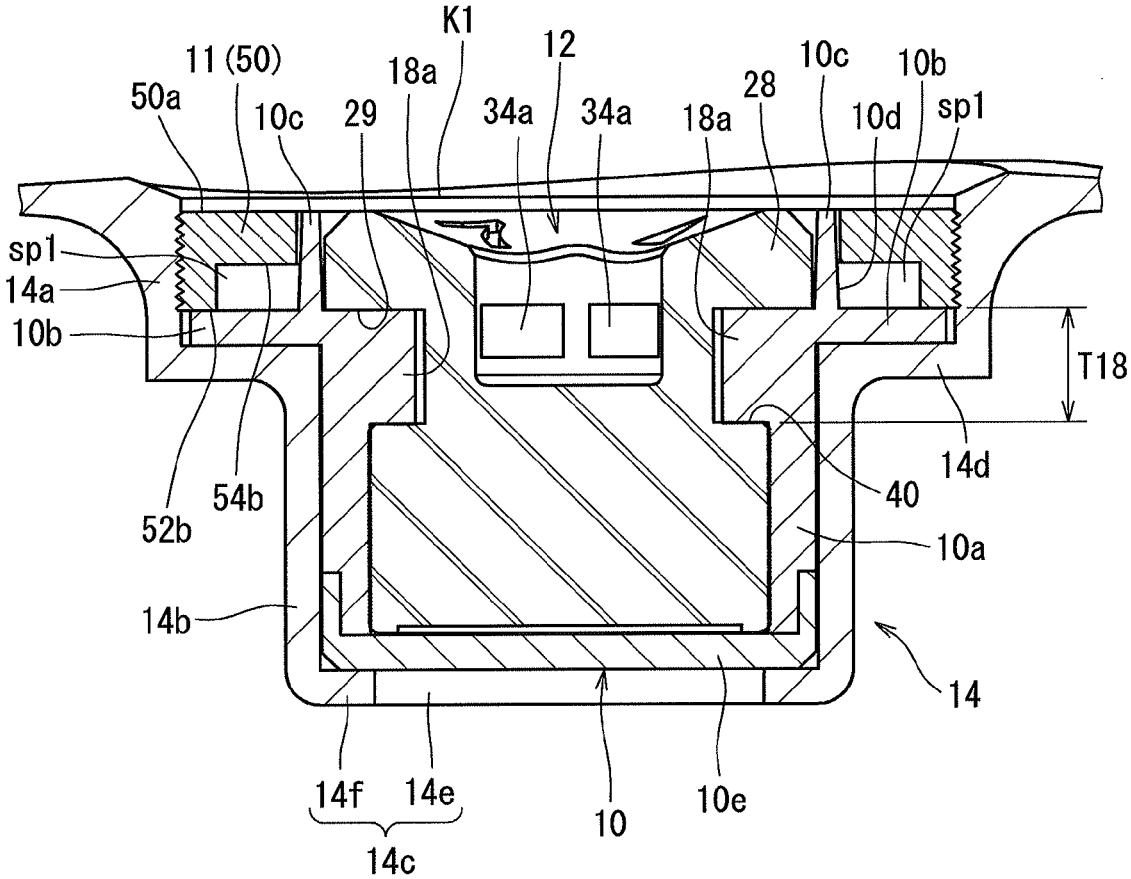
FIG. 21 is a cross-sectional view taken along line H-H in FIG. 14.

FIG. 18 is a cross-sectional view taken along line E-E in FIG. 13. FIG. 18 is a cross-sectional view at the non-engaging position NP. FIG. 19 is a cross-sectional view taken along line F-F in FIG. 14. FIG. 19 is a cross-sectional view at the engaging position EP. FIG. 20 is a cross-sectional view taken along line G-G in FIG. 14. FIG. 20 is a cross-sectional view at the engaging position EP. FIG. 21 is a cross-sectional view taken along line H-H in FIG. 14. FIG. 21 is a cross-sectional view at the engaging position EP.

Figure 22:
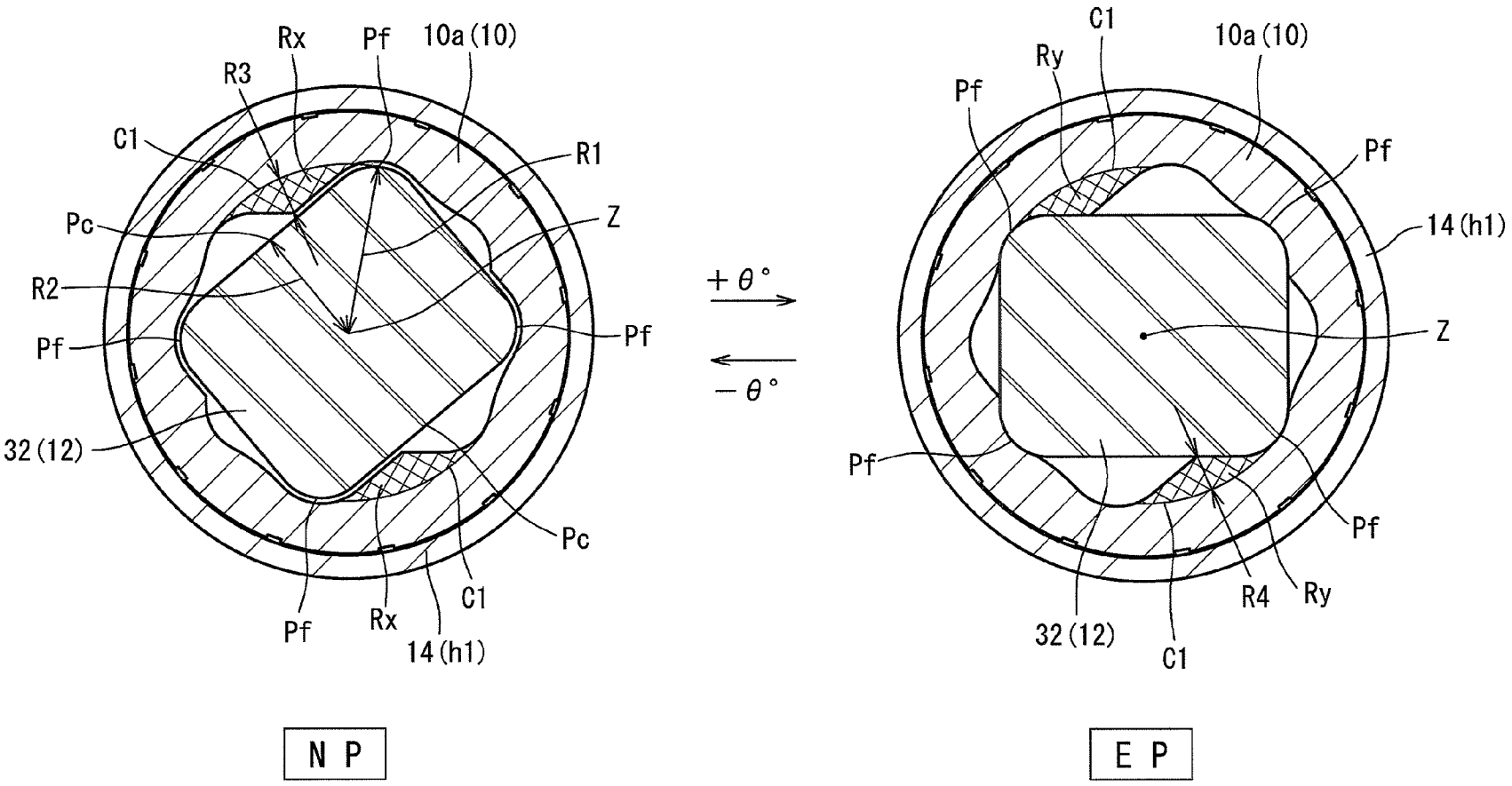
FIG. 22 is cross-sectional views at the non-engaging position NP and the engaging position EP, in which the left side in FIG. 22 is a cross-sectional view taken along line J-J in FIG. 18, and the right side in FIG. 22 is a cross-sectional view taken along line K-K in FIG. 19.

FIG. 22 is a cross-sectional view of the mutual transition between the engaging position EP and the non-engaging position NP. A left side in FIG. 22 is a cross-sectional view taken along line J-J in FIG. 18, and is a cross-sectional view at the non-engaging position NP. A right side in FIG. 22 is a cross-sectional view taken along line K-K in FIG. 19, and is a cross-sectional view at the engaging position EP.

As described above, the socket 10 includes the first hole portion 18 and the second hole portion 20. The cross-sectional shape of the first hole portion 18 is different from the cross-sectional shape of the second hole portion 20. The difference in the cross-sectional shape causes the step surface 22.

As illustrated in FIG. 21, the first hole portion 18 includes an inner protruding portion 18*a*. The lower surface of the inner protruding portion 18*a* is the step surface 22.

At the non-engaging position NP, the inner protruding portion 18*a* is not engaged with the weight body 12. On the other hand, at the engaging position EP, the inner protruding portion 18*a* is engaged with the weight body 12. As illustrated in FIG. 21, at the engaging position EP, the inner protruding portion 18*a* is held between the lower surface 29 and the engaging surface 40. Thus, the fixing of the weight body 12 is reliably attained.

In FIG. 21, a two-directional arrow T18 expresses the thickness of the inner protruding portion 18*a* in the axial direction. As illustrated in FIG. 6, the step surface 22 is sloped. Because of the slope, the axial-directional thickness T18 is changed. As the weight body 12 is more rotated to the engaging position EP, the axial-directional thickness T18 of a portion engaged with the weight body 12 is more increased. At the engaging position EP, the inner protruding part 18*a* is compressively deformed so as to decrease the thickness T18. The pressing force is applied from the inner protruding portion 18*a* to the lower surface 29 and the engaging surface 40 by the restoring force of the compressive deformation. For this reason, the fixing of the weight body 12 is further reliably attained.

The axial-directional thickness T18 is gradually changed. Thus, the mutual transition between the engaging position EP and the non-engaging position NP can be smoothly performed.

As described above, in the weight body attaching/detaching mechanism M1, Configuration C, Configuration D, and Configuration F below are attained. With Configuration C, the fixing of the weight body 12 is further reliably attained. Moreover, Configuration D and Configuration E facilitate attaching and detaching work.

[Configuration C] At the engaging position EP, the weight body 12 holds the inner protruding portion 18*a* of the socket 10, and compressively deforms the inner protruding portion 18*a*.

[Configuration D] In the process in which the weight body 12 goes from the non-engaging position NP to the engaging position EP, the amount of the compressive deformation of the inner protruding portion 18*a* is more increased as the weight body 12 comes closer to the engaging position EP.

[Configuration E] At the non-engaging position NP, the compressive deformation of the inner protruding portion 18*a* is not caused.

A crosshatched portion on the left side in FIG. 22 (at the non-engaging position NP) expresses a reverse rotation suppressing portion Rx. A circular arc C1 defining the reverse rotation suppressing portion Rx is a part of a circle in which the axis line Z is the center point and a distance from the center point Z to a point Pf is a radius R1. The point Pf is a point the farthest from the point Z on the outline of the cross section of the engaging portion 32. The reverse rotation suppressing portion Rx can prevent reverse rotation in locking. The reverse rotation suppressing portion Rx promotes correct rotation to the engaging position EP (rotation of an angle of +θ°. That is, the effect of promoting normal rotation is exerted.

A crosshatched portion on the right side in FIG. 22 (at the engaging position EP) expresses an excess rotation suppressing portion Ry. The circular arc C1 defining the excess rotation suppressing portion Ry is as described above. The excess rotation suppressing portion Ry can prevent excess rotation in locking. The excess rotation suppressing portion Ry prevents the engaging portion 32 at the engaging position EP from excessively rotating beyond the engaging position EP, and promotes the attainment of the engaging position EP. That is, the effect of suppressing excess rotation is exerted.

In the embodiment, the reverse rotation suppressing portion Rx and the excess rotation suppressing portion Ry are large, as described later. Thus, the effect of promoting normal rotation and the effect of suppressing excess rotation are high. In the embodiment, the projection forming the excess rotation suppressing portion Ry is also the reverse rotation suppressing portion Rx. When the weight body 12 is at the engaging position EP, the excess rotation suppressing portion Ry is compressed by the engaging portion 32, and slightly deformed. On the other hand, when the weight body 12 is at the non-engaging position NP, the reverse rotation suppressing portion Rx is not compressively deformed. It is noted that the projection forming the excess rotation suppressing portion Ry and the projection forming the reverse rotation suppressing portion Rx may be provided separately.

Figure 23:
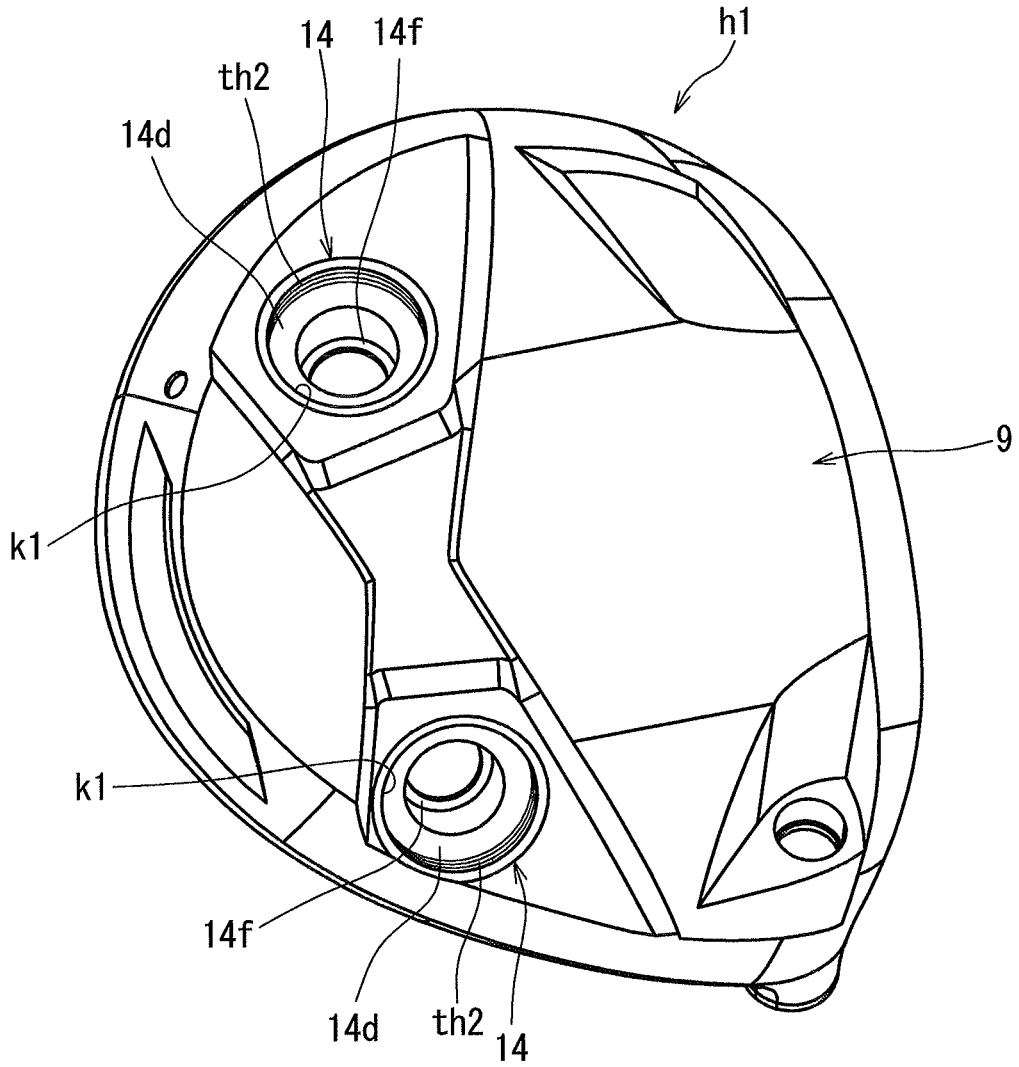
FIG. 23 is a perspective view of a head main body.

FIG. 23 is a perspective view of the head main body h1. As described above, the head main body h1 includes two socket housing portions 14. The socket housing portion 14 may be a recess or a hole.

From the viewpoint of strength and durability, preferably, the material of the socket housing portion 14 is a metal. In the embodiment, the socket housing portion 14 is integrally formed with the other portions of the head main body h1. The socket housing portion 14 may be separately formed from the other portions of the head main body h1. In this case, preferably, the socket housing portion 14 is fixed to the head main body h1 by welding.

Figure 24:
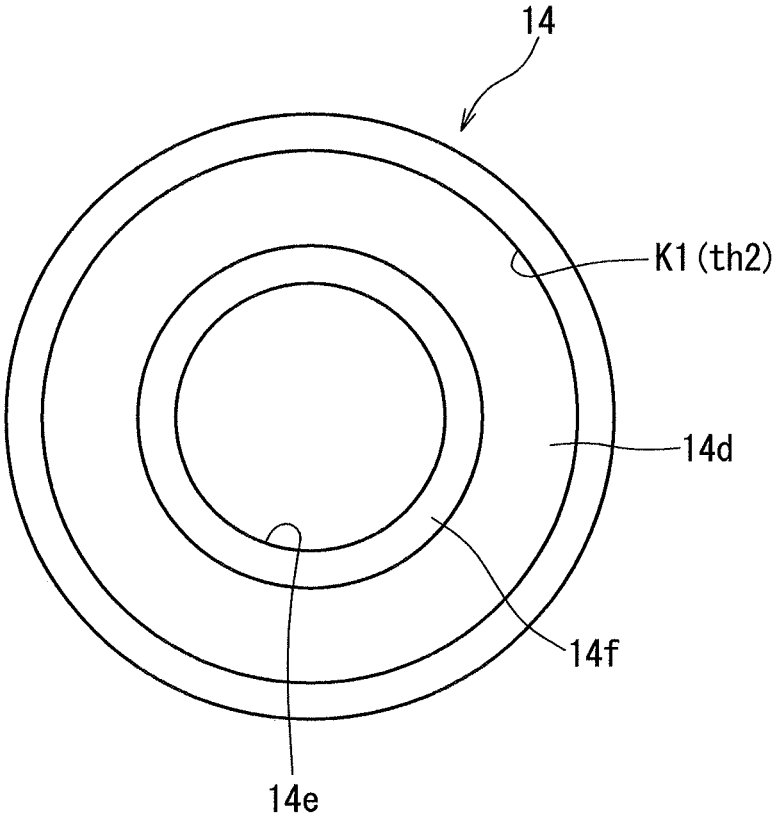
FIG. 24 is a plan view of the socket housing portion.
Figure 25:
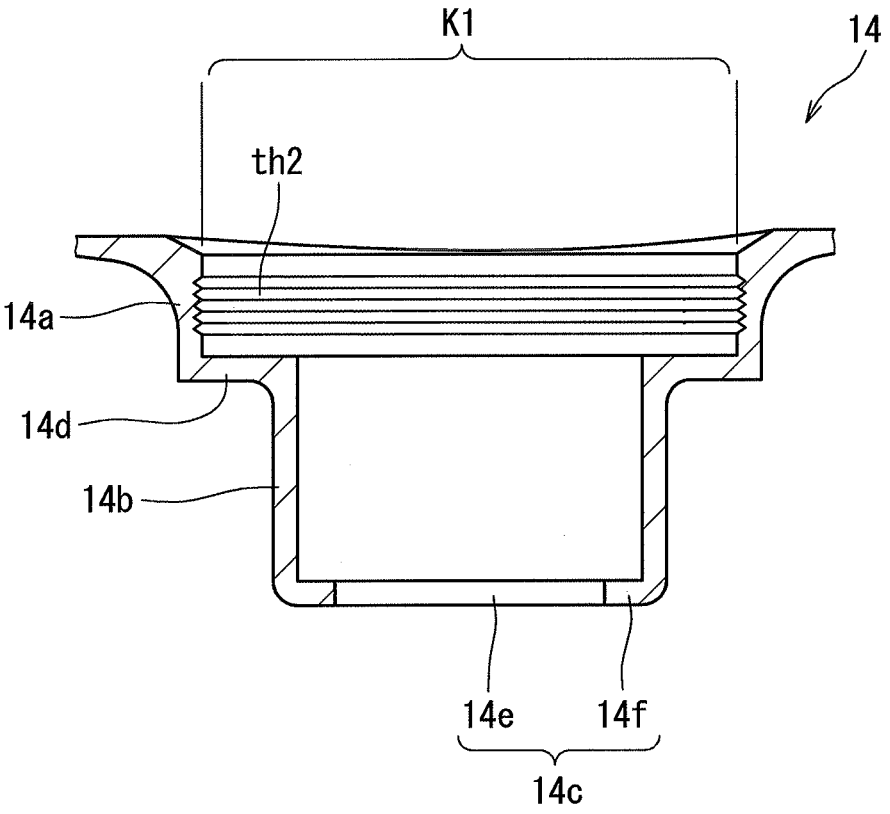
FIG. 25 is a cross-sectional view of the socket housing portion.

FIG. 24 is a plan view of the socket housing portion 14. FIG. 25 is a cross-sectional view of the socket housing portion 14. The socket housing portion 14 can house at least a part of the socket 10. In the embodiment, the socket housing portion 14 houses the socket 10 entirely.

The socket housing portion 14 includes a first side wall portion 14*a*, a second side wall portion 14*b*, a bottom portion 14*c*, and a step portion 14*d*. The first side wall portion 14*a* and the second side wall portion 14*b* are the side wall portions of the socket housing portion 14. The bottom portion 14*c* includes a through hole 14*e* and an inward extending portion 14*f*. The inner circumferential surface of the first side wall portion 14*a* is coaxial with the inner circumferential surface of the second side wall portion 14*b*. The inner diameter of the first side wall portion 14*a* is greater than the inner diameter of the second side wall portion 14*b*. The step portion 14*d* joins the first side wall portion 14*a* to the second side wall portion 14*b*. The inward extending portion 14*f* is in a flange shape.

The inner diameter of the first side wall portion 14*a* may be the same as the inner diameter of the second side wall portion 14*b*. Moreover, the step portion 14*d* may not be provided.

As illustrated in FIG. 25, a screw thread th2 is provided on the inner circumferential surface of the first side wall portion 14*a*. The screw thread th2 is a female thread. The screw thread th2 is fitted into the screw thread th1 of the ring member 50. The screw thread th1 and the screw thread th2 can be screwed with each other. That is, the ring member 50 can be attached to the first side wall portion 14*a* by screwing. It is noted that in the present application, the screw thread th2 is omitted in some of the drawings.

The socket housing portion 14 includes a first opening K1. The first opening K1 is opened to the outer side of the head. The first side wall portion 14*a* forms the first opening K1. The socket 10 can be housed in the socket housing portion 14 through the first opening K1. The socket 10 is passed through the first opening K1, and disposed on the socket housing portion 14.

As illustrated in FIGS. 18 to 21, the outer diameter of the main body portion 10*a* is substantially the same as the inner diameter of the second side wall portion 14*b*. The outer surface of the main body portion 10*a* contacts the inner circumferential surface of the second side wall portion 14*b*.

The socket 10 is supported on the inward extending portion 14*f* from the lower side. The diameter of the through hole 14*e* is smaller than the outer diameter of the bottom face of the socket 10. The socket 10 does not drop into the head 4. The weight of the socket housing portion 14 is reduced because of the through hole 14*e*.

As illustrated in FIGS. 18 to 21, the ring member 50 is disposed so as to block a part of the first opening K1. The ring member 50 is disposed so as to block the edge of the first opening K1. The held portion 10*b* is positioned on the lower side of the ring member 50. The outer diameter of the held portion 10*b* is greater than the inner diameter of the ring member 50. The socket 10 cannot pass through the ring member 50. The ring member 50 controls the falling off of the socket 10. The ring member 50 controls the falling off of the socket 10 out of the first opening K1. The ring member 50 prevents the socket 10 from falling off.

As illustrated in FIGS. 18 to 21, the held portion 10*b* is supported by the step portion 14*d* from the lower side. The held portion 10*b* is held between the step portion 14*d* and the ring member 50. The screwing amount of the ring member 50 can adjust the force of holding the held portion 10*b*. As the amount of the ring member 50 screwed is increased, the held portion 10*b* is more strongly held.

The held portion 10*b* is pressed by the ring member 50. By the press, the held portion 10*b* is compressively deformed. By the press, the fixing of the socket 10 is further reliably attained. The ring member 50 reliably fixes the socket 10 in a simple structure.

The range of providing the screw thread th1 and the screw thread th2 in the axial direction is set so as to allow the press by the ring member 50.

The ring member 50 suppress the falling off of the socket 10 by the effect of reducing the first opening K1 and the effect of pressing the socket 10.

The held portion 10*b* may not be in a flange shape. For example, the outer diameter of the socket 10 may be constant on the lower side of the held portion 10*b*. In this case, the inner shape of the socket housing portion 14 is also changed correspondingly to the outer shape of the socket 10. For example, the inner diameter of the second side wall portion 14*b* is made the same as the first side wall portion 14*a*. In the embodiment, the held portion 10*b* is in a flange shape, so that the volume of the socket 10 is reduced. Thus, the weight of the socket 10 is reduced.

The ring member 50 is mechanically joined to the head main body h1. As described above, in the embodiment, the mechanical joining is screw joining. As compared with adhesive joining, the mechanical joining is excellent in reliability. The mechanical joining is excellent in impact resistance. The ring member 50 is unlikely to fall off because of the mechanical joining. Thus, the falling off of the socket 10 is effectively suppressed. The mechanical joining includes screw joining and fitting.

As described above, the ring member 50 includes the second opening K2. The weight body 12 can be passed through the second opening K2. The ring member 50 suppresses the falling off of the socket 10 while allowing the weight body 12 to be inserted into the socket 10.

The screw joining is released to detach the ring member 50. The ring member 50 is detachably attached. The socket 10 may be fixed to the head main body h1 with an adhesive, for example, or the press by the ring member 50 may be combined with an adhesive. The socket 10 may be fixed to the head main body h1 only using the ring member 50. In the case where no adhesive is used, the socket 10 is replaceable. That is, the ring member 50 is detached, and the socket 10 can also be detached. Thus, it may be fine that the socket 10 can be detached by detaching the ring member 50.

As described above, the socket 10 is formed of a polymer. The socket 10 is provided between the socket housing portion 14 and the weight body 12. The socket 10 prevents the weight body 12 from contacting the socket housing portion 14. When the weight body 12 contacts the socket housing portion 14, an unusual sound can be made. Since the polymer socket 10 is provided, the occurrence of the unusual sound is suppressed.

As described above, the elastic modulus Es of the socket 10 is smaller than the elastic modulus Eh of the head main body h1. The elastic modulus Es of the socket 10 is smaller than an elastic modulus Ea of the socket housing portion 14. The socket 10 of a low elastic modulus can effectively relax an impact applied to the weight body 12. Thus, the occurrence of an unusual sound is further suppressed. It is noted that in the present application, the elastic modulus means Young's modulus.

As illustrated in FIGS. 18 to 21, the intermediate portion 10*c* of the socket 10 is positioned on the inner side of the ring member 50. The intermediate portion 10*c* is positioned between the ring member 50 and the weight body 12. The intermediate portion 10*c* prevents the weight body 12 from directly contacting the ring member 50. The intermediate portion 10*c* suppresses the occurrence of an unusual sound.

The ring member 50 contacts at least a part of an outer side surface 10*d* of the intermediate portion 10*c*. In the embodiment, the outer side surface 10*d* is substantially a circumferential surface. More correctly, the outer side surface 10*d* is a circular conical surface. The ring member 50 contacts the outer side surface 10*d* on a part of the outer side surface 10*d* in the circumferential direction. The ring member 50 may contact the outer side surface 10*d* entirely on the outer side surface 10*d* in the circumferential direction.

The ring member 50 contacts the outer side surface 10*d*, so that vibrations of the weight body 12 can be suppressed. This point will be described. Here, let us consider a gap X between the intermediate portion 10*c* and the weight body 12 (see FIG. 18). In the case where the gap X is excessively large, the weight body 12 is apt to vibrate. Specifically, since the head portion 28 is at a position apart from the engaging portion 32, the weight body 12 is apt to vibrate. From the viewpoint of preventing the weight body 12 from falling off, excessive vibrations of the weight body 12 are not preferable. From this viewpoint, preferably, the gap X is small. The inner diameter of the intermediate portion 10*c* can be designed in such a way that the gap X is substantially zero. However, in this case, a problem of the shaping errors of the socket 10 possibly arises. That is, in the case where the intermediate portion 10*c* is excessively small due to shaping errors, the intermediate portion 10*c* can interfere in inserting and rotating the weight body 12. From this viewpoint, preferably, a slight gap X is provided in the design value.

On the other hand, the outer diameter and inner diameter of the intermediate portion 10*c* are sometimes increased due to the errors. In this case, the gap X can be excessively larger than the design value. However, the inner diameter of the ring member 50 regulates the outer diameter of the intermediate portion 10*c*. Since the ring member 50 contacts the outer side surface 10*d*, the gap X is prevented from being excessively large. Thus, vibrations of the weight body 12 can be suppressed.

Since the ring member 50 contacts the outer side surface 10*d*, the outer displacement of the outer side surface 10*d* is suppressed. The displacement of the outer side surface 10*d* is suppressed, so that the displacement of the weight body 12 can also be suppressed. Thus, the displacement of the outer side surface 10*d* is suppressed, so that vibrations of the weight body 12 can be effectively suppressed. The weight body 12 whose vibrations are suppressed is unlikely to fall off.

As illustrated in FIGS. 18 to 21, a space sp1 is provided between the ring member 50 and the socket 10. The space sp1 is provided between the ring member 50 and the held portion 10*b*. A part of the lower surface (the lower surface 52*b*) of the ring member 50 contacts the held portion 10*b*, and the other portion (the lower surface 54*b*) of the lower surface of the ring member 50 are apart from the held portion 10*b*. Since the lower surface 54*b* is apart from the held portion 10*b*, the space sp1 is formed. The space sp1 is provided between the ring member 50 and the intermediate portion 10*c*. The space sp1 is in a substantially annular shape. The space sp 1contributes to a reduction in the weight of the ring member 50.

As described above, the ring member 50 presses the held portion 10*b*. More specifically, the lower surface 52*b* of the outer circumferential portion 52 presses the held portion 10*b*. Meanwhile, the lower surface 54*b* of the inner circumferential portion 54 does not contact the held portion 10*b*. The space sp1 is formed between the lower surface 54*b* and the held portion 10*b*. Thus, the ring member 50 has a shape in which the held portion 10*b* can be pressed and the space sp1 can be formed. Therefore, the ring member 50 can firmly fix the socket 10 while attaining a reduction in the weight.

In the present application, the specific gravity of the head main body h1 is G1, the specific gravity of the attachment member 11 (the ring member 50) is G2, and the specific gravity of the socket 10 is G3 . In the embodiment, the specific gravity G1 is greater than the specific gravity G2. In other words, the specific gravity G2 is smaller than the specific gravity G1. Thus, a reduction in the weight of the attachment member 11 is attained. Because of a reduction in the weight of the attachment member 11, a large mass can be allocated to the weight body 12. Therefore, the degree of freedom of adjusting the position of the center of gravity of the head is improved.

In the embodiment, the specific gravity G2 of the attachment member 11 is greater than the specific gravity G3 of the socket 10. The attachment member 11 of a high specific gravity is disposed on the sole side of the socket 10. Thus, the position of the center of gravity of the head 4 is provided at a lower position.

As illustrated in FIG. 17, the cross-sectional shape of the engaging portion 32 is in a substantially rectangular shape. The term "substantially" means that the modification of the corner is allowed. A typical example of a substantially rectangular shape includes a rectangle with rounded corners as in the embodiment. Another example of a substantially rectangular shape includes a rectangle with beveled corners.

The cross-sectional shape of the engaging portion 32 may be N-fold symmetry in which the axis line Z is the rotation axis. N is an integer of one or greater and four or less, for example. In a substantially rectangular shape in the embodiment, N is two. That is, the substantially rectangle is in two-fold rotation symmetry.

The N-fold rotation symmetry means that a shape after rotated by an angle of 360/N degrees about the rotation axis is matched with the shape before rotated, where N is a natural number. In other words, N is an integer equal to or greater than one. Preferably, N is an integer of one or greater and four or less. It is noted that in the general definition of rotation symmetry, N is an integer equal to or greater than two. However, in the present application, N includes one. In the general definition, rotation symmetry is not provided in the case where N is one. However, N may be one in the present application. That is, in the present application, the cross-sectional shape of the engaging portion 32 may be in "one-fold symmetry".

In Japanese Utility Model Registration Publication No. 3142270 described above, the cross-sectional shape of the engaging portion is in a substantially square shape. In Japanese Utility Model Registration Publication No. 3142270, N is four. In the case where the cross-sectional shape of the engaging portion is in a substantially square shape, the hole 16 and the engaging portion 32 of the socket 10 are relatively easily designed. Moreover, in the case where N is four, the circumferential positions of the weight body 12 that can be fitted into the first hole portion 18 can also be four. When the weight body 12 is inserted into the hole 16, it is necessary to fit the engaging portion 32 into the first hole portion 18. Because of the fitting, it is necessary to rotate the weight body 12. Since N is four, the amount of rotation of the weight body 12 for the fitting can be suppressed. This amount of rotation is suppressed, so that the weight body 12 can be easily inserted into the hole 16. On the other hand, as illustrated in FIGS. 5 to 7 in Japanese Utility Model Registration Publication No. 3142270, in the case where the cross-sectional shape of the engaging portion is in a substantially square shape, the reverse rotation suppressing portion Rx and the excess rotation suppressing portion Ry are apt to be decreased in size as compared with the case where N is equal to or less than three. Thus, the reverse rotation and the excess rotation described above are apt to occur. In the case where N is equal to or less than three, the reverse rotation suppressing portion Rx and the excess rotation suppressing portion Ry are likely to be increased in size. Thus, reverse rotation and excessive rotation described above are effectively suppressed. From the viewpoint of suppressing reverse rotation and excessive rotation, preferably, N is one or greater and three or less.

In the case where N is equal to or less than three, the rotation angle necessary for reverse rotation and excessive rotation is increased as well as the reverse rotation suppressing portion Rx and the excess rotation suppressing portion Ry can be increased in size. Thus, reverse rotation and excessive rotation can be effectively reduced. For this reason, the reverse rotation suppressing portion Rx and the excess rotation suppressing portion Ry are unlikely to be damaged. As a result, the socket 10 is unlikely to deteriorate even though the socket 10 is repeatedly used.

An example of the case where N is four includes a substantially square shape. An example of the case where N is three includes a substantially regular triangular shape. An example of the case where N is two includes a substantially parallelogram shape in addition to the substantially rectangular shape as in the embodiment. In the case where N is equal to or less than three, preferably, N is two. In this case, the cross-sectional shape of the engaging portion 32 is relatively simple as compared with the case where N is one. Thus, the engaging portion 32 and the socket 10 are easily designed.

In the present application, the longest rotation radius of the engaging portion 32 is R1. Moreover, the shortest rotation radius of the engaging portion 32 is R2. The radius R1 is as described above. That is, as illustrated in FIG. 22, the radius R1 is the distance between the rotation center Z and the point Pf. The radius of R2 is the distance between the rotation center Z and a point Pc. The point Pc is a point the nearest to the point Z on the outline of the section of the engaging portion 32 (see FIG. 22).

From the viewpoint of enlarging the reverse rotation suppressing portion Rx and the excess rotation suppressing portion Ry, R1/R2 is preferably equal to or greater than 1.30, more preferably equal to or greater than 1.33, and still more preferably equal to or greater than 1.36. From the viewpoint of downsizing the socket housing portion 14 and the socket 10, R1/R2 is preferably equal to or less than 1.70, more preferably equal to or less than 1.60, and still more preferably equal to or less than 1.50. It is noted that in the embodiment, R1/R2 is 1.39.

In the cross-sectional view at the non-engaging position NP in FIG. 22, a crosshatched portion expresses a cross-sectional area X of the reverse rotation suppressing portion Rx. From the viewpoint of suppressing the reverse rotation, the cross-sectional area X is preferably equal to or greater than 1.5 $mm^2$, more preferably equal to or greater than 2.0 $mm^2$, and still more preferably equal to or greater than 2.5 $mm^2$. From the viewpoint of downsizing the socket housing portion 14 and the socket 10, the cross-sectional area X is preferably equal to or less than 5.0 $mm^2$, more preferably equal to or less than 4.5 $mm^2$, and still more preferably equal to or less than 4.0 $mm^2$. The cross-sectional area X is the cross-sectional area of a single reverse rotation suppressing portion Rx.

In the cross-sectional view at the engaging position EP in FIG. 22, a crosshatched portion expresses a cross-sectional area Y of the excess rotation suppressing portion Ry. From the viewpoint of suppressing the over rotation, the cross-sectional area Y is preferably equal to or greater than 1.5 $mm^2$, more preferably equal to or greater than 2.0 $mm^2$, and still more preferably equal to or greater than 2.5 $mm^2$. From the viewpoint of downsizing the socket housing portion 14 and the socket 10, the cross-sectional area Y is preferably equal to or less than 5.0 $mm^2$, more preferably equal to or less than 4.5 $mm^2$, and still more preferably equal to or less than 4.0 $mm^2$. The cross-sectional area Y is the cross-sectional area of a single excess rotation suppressing portion Ry.

In FIG. 22, a two-directional arrow R3 expresses the maximum height of the reverse rotation suppressing portion Rx. The height R3 is measured along the radial direction. From the viewpoint of suppressing the reverse rotation, R3/R1 is preferably equal to or greater than 0.19, more preferably equal to or greater than 0.20, and still more preferably equal to or greater than 0.21. From the viewpoint of downsizing and reducing the weight of the socket housing portion 14 and the socket 10, R3/R1 is preferably equal to or less than 0.24, more preferably equal to or less than 0.23, and still more preferably equal to or less than 0.22.

It is noted that the radial direction is the direction of a straight line Lp in FIG. 17. The straight line Lp is a straight line intersecting with the axis line Z and perpendicular to the axis line Z.

In FIG. 22, a two-directional arrow R4 expresses the maximum height of the excess rotation suppressing portion Ry. The height R4 is measured along the radial direction. From the viewpoint of suppressing the over rotation, R4/R1 is preferably equal to or greater than 0.19, more preferably, equal to or greater than 0.20, and still more preferably equal to or greater than 0.21. From the viewpoint of downsizing and reducing the weight of the socket housing portion 14 and the socket 10, R4/R1 is preferably equal to or less than 0.24, more preferably equal to or less than 0.23, and still more preferably equal to or less than 0.22.

[Hardness Hs of the Socket]

From the viewpoint of reliably attaining the fixing of the weight body 12 and suppressing the occurrence of an unusual sound when hitting a ball, the hardness Hs of the socket 10 is preferably equal to or greater than D40, more preferably equal to or greater than D42, and still more preferably equal to or greater than D45. From the viewpoint of the abrasion resistance property, the hardness Hs is preferably equal to or less than D80, more preferably equal to or less than D78, and still more preferably equal to or less than D76.

The hardness Hs is measured in accordance with the regulation of "ASTM-D 2240-68" using a Shore D type hardness scale attached to an automated rubber hardness measuring device ("P1" (trade name) manufactured by Koubunshi Keiki Co., Ltd.). The shape of a measurement sample is a cube having a side length of 3 mm. Measurement is performed under a temperature of 23° C. The measurement sample is cut out from the socket 10 if possible. In the case where it is difficult to cut out the measurement sample, a measurement sample made of the same resin composition as that of the socket 10 is used.

[Polymer]

From the viewpoint of the hardness, preferably, the material of the socket is a polymer. The polymer includes a thermosetting polymer and a thermoplastic polymer. The thermosetting polymer includes a phenol resin, an epoxy resin, a melamine resin, a urea resin, an unsaturated polyester resin, an alkyd resin, a thermosetting polyurethane, a thermosetting polyimide, and a thermosetting elastomer. The thermoplastic polymer includes polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, a thermoplastic polyimide, polyamide imide, and a thermoplastic elastomer.

The thermoplastic elastomer includes a thermoplastic polyamide elastomer, a thermoplastic polyester elastomer, a thermoplastic polystyrene elastomer, a thermoplastic polyester elastomer, and a thermoplastic polyurethane elastomer.

From the viewpoint of durability, a urethane-based polymer and polyamide are preferable, and the urethane-based polymer is more preferable. The urethane-based polymer includes polyurethane and a thermoplastic polyurethane elastomer. The urethane-based polymer may be a thermoplastic polymer, or may be a thermosetting polymer. From the viewpoint of formability, a thermoplastic urethane-based polymer is preferable, and the thermoplastic polyurethane elastomer is more preferable.

From the viewpoint of formability, the thermoplastic polymer is preferable. From the viewpoint of hardness and durability, in the thermoplastic polymer, the polyamide and the thermoplastic polyurethane elastomer are preferable, and the thermoplastic polyurethane elastomer is more preferable.

The polyamide includes nylon 6, nylon 11, nylon 12, and nylon 66.

A preferable thermoplastic polyurethane elastomer contains a polyurethane component as a hard segment, and a polyester component or a polyether component as a soft segment. That is, a preferable thermoplastic polyurethane elastomer (TPU) includes a polyester-based TPU and a polyether-based TPU. A curing agent for the polyurethane component includes cycloaliphatic diisocyanate, aromatic diisocyanate, and aliphatic diisocyanate.

The cycloaliphatic diisocyanate includes 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI).

The aromatic di-isocyanate includes diphenylmethane diisocyanate (MDI) and toluene diisocyanate (TDI). The aliphatic diisocyanate includes hexamethylene diisocyanate (HDI).

A commercially available thermoplastic polyurethane elastomer (TPU) includes "Elastollan" (trade name) manufactured by BASF Japan Ltd.

Specific examples of the polyester-based TPU include "Elastollan C70A", "Elastollan C80A", "Elastollan C85A", "Elastollan C90A", "Elastollan C95A", and "Elastollan C64D", for example.

Specific examples of the polyether-based TPU include "Elastollan 1164D", "Elastollan 1198A", "Elastollan 1180A", "Elastollan 1188A", "Elastollan 1190A", "Elastollan 1195A", "Elastollan 1174D", "Elastollan 1154D", and "Elastollan ET385", for example.

From the viewpoint of versatility and productivity, an example of a preferable material of the socket is a resin. A fiber reinforced resin containing the polymers as a matrix may be used.

Figure 26:
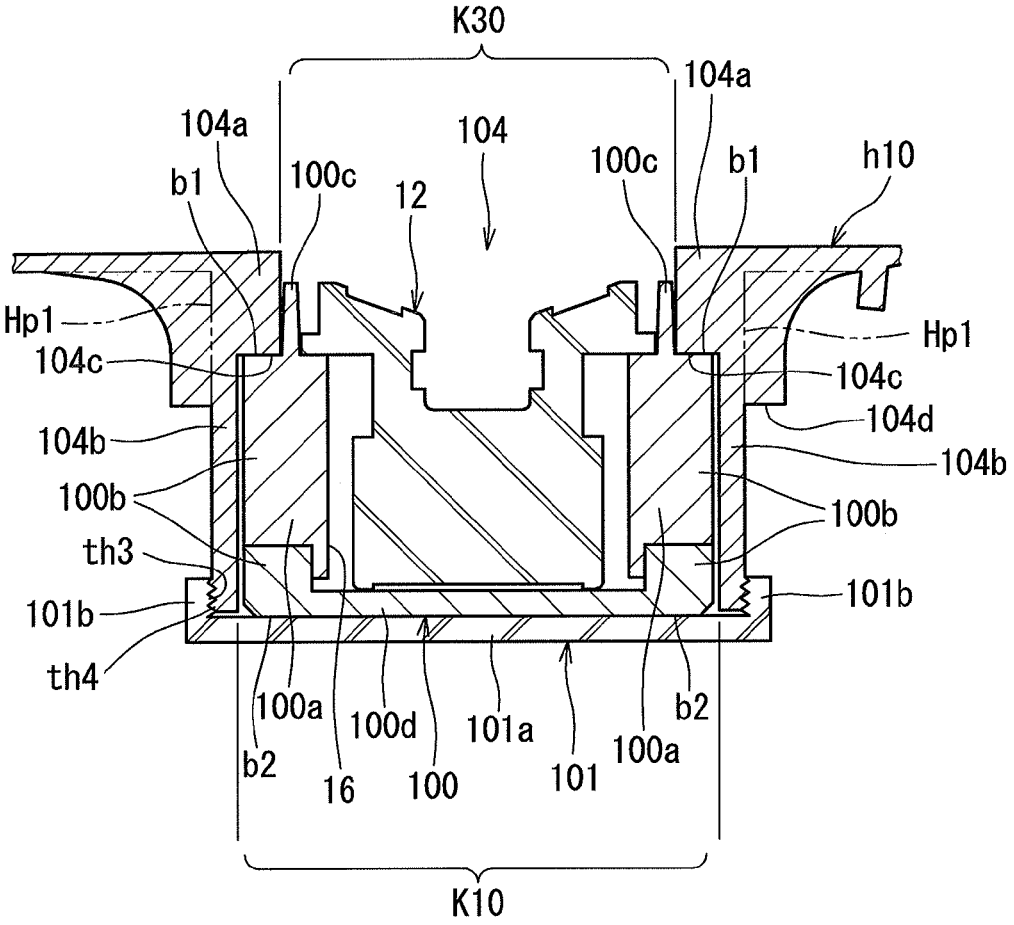
FIG. 26 is a cross-sectional view of a head according to an exemplary modification.

FIG. 26 is a cross-sectional view around a socket housing portion of a head according to an exemplary modification. The head includes a head main body h10, a socket 100, an attachment member 101, and a weight body 12. The weight body 12 is as described above.

The socket 100 includes a main body portion 100*a*, a held portion 100*b*, an intermediate portion 100*c*, and a bottom face forming part 100*d*. The held portion 100*b* is positioned on the outer side of the main body portion 100*a*. The main body portion 100*a* includes a hole 16. The hole 16 is as described above.

The head main body h10 includes a socket housing portion 104. The socket housing portion 104 includes an inward extending portion 104*a* and a side wall portion 104*b*. The inward extending portion 104*a* forms a flange. The inward extending portion 104*a* forms a downward surface 104*c*. The side wall portion 104*b* includes a first opening K10. The first opening K10 is opened to the inner side of the head. The inward extending portion 104*a* includes a third opening K30. The third opening K30 is opened to the outer side of the head.

The inner diameter of the side wall portion 104*b* is constant. On the other hand, the outer diameter of the side wall portion 104*b* is not constant. The side wall portion 104*b* includes a step surface 104*d*. The thickness of the side wall portion 104*b* is changed at the boundary of the step surface 104*d*.

The inner diameter of the inward extending portion 104*a* is constant. The inner diameter of the inward extending portion 104*a* is smaller than the inner diameter of the side wall portion 104*b*. The inner circumferential surface of the inward extending portion 104*a* is coaxial with the inner circumferential surface of the side wall portion 104*b*.

The attachment member 101 is in a substantially disc shape as a whole. The attachment member 101 includes a center portion 101*a* and an outer edge portion 101*b*. The outer edge portion 101*b* is in an annular ring shape. The outer edge portion 101*b* extends from the peripheral area of the center portion 101*a* to the upper side.

A screw thread th3 is formed on the inner circumferential surface of the outer edge portion 101*b*. The screw thread th3 is a female thread. A screw thread th4 is also formed on the socket housing portion 104 correspondingly to the screw thread th3. The screw thread th4 is formed on the outer circumferential surface of the side wall portion 104*b*. The screw thread th4 is formed on the lower end portion of the side wall portion 104*b*. The screw thread th3 is screwed to the screw thread th3.

Thus, the attachment member 101 is screwed to the socket housing portion 104. As described above, screw joining is mechanical joining.

The attachment member 101 blocks the first opening K10 . The first opening K10 is blocked by the attachment member 101. The attachment member 101 controls the socket 100 to move so as not to pass through the first opening K10. The socket 100 does not fall into the head.

The maximum outer diameter of the socket 100 is greater than the inner diameter of the inward extending portion 104*a*. The socket 100 cannot pass through the third opening K30. The third opening K30 does not allow the socket 100 to pass. The socket 100 does not fall out to the outer side of the head. Meanwhile, the third opening K30 allows the weight body 12 to be inserted into the socket 100. The third opening K30 does not prevent the attachment and detachment of the weight body 12.

The held portion 100*b* includes a top surface b1 and a lower surface b2. The top surface b1 contacts the downward surface 104*c*. The lower surface b2 contacts the attachment member 101. The held portion 100*b* is held between the attachment member 101 and the head main body h10. The held portion 100*b* is pressed against the attachment member 101. As the attachment member 101 is more screwed, the pressing force becomes greater.

By the press of the attachment member 101, the held portion 100*b* is compressively deformed. The held portion 100*b* is compressed in the axial direction. The press of the attachment member 101 reliably fix the socket 100.

The socket 100 is inserted from the inner side of the head into the socket housing portion 104. The top surface b1 contacts the downward surface 104*c*, and then the inserted socket housing portion 104 is positioned in the axial direction. In the positioned state, the bottom face of the socket 100 protrudes on the outer side of the head beyond the first opening K10. Subsequently, the attachment member 101 is screwed. When the attachment member 101 is more screwed, the top surface of the center portion 101*a* contacts the bottom face of the socket 100. When the attachment member 101 is further more screwed, the attachment member 101 presses the socket 100.

As described above, the thickness of the side wall portion 104*b* is changed at the boundary of the step surface 104*d*. The outer diameter of the side wall portion 104*b* is changed at the boundary of the step surface 104*d*. The outer diameter on the upper side of the step surface 104*d* is increased. The step surface 104*d* may be eliminated. That is, the outer diameter of the side wall portion 104*b* may be constant. For example, the outer surface of the socket housing portion 104 may be formed as depicted by a long dashed double-short dashed line Hp1. In the exemplary modification illustrated by the long dashed double-short dashed line Hp1, the outer diameter of the socket housing portion 104 is constant. Since the outer diameter of the side wall portion 104*b* is made constant, the structure of the socket housing portion 104 is simplified, and the weight of the socket housing portion 104 can be reduced. Moreover, in the exemplary modification illustrated by the long dashed double-short dashed line Hp1, the outer diameter of the socket housing portion 104 is constant. Thus, the effects of simplification and a reduction in the weight are further improved.

EXAMPLES

In the following, the effects of the present invention will be clarified by examples. However, the present invention should not be interpreted in a limited way based on the description of the examples.

First Example

A head having the same structure as that of the head 4 was prepared as below.

A face member was obtained by pressing a rolled material made of a titanium alloy (Ti-6Al-4V). A body was obtained by casting using a titanium alloy (Ti-6Al-4V). The body included a socket housing portion. The obtained face member was welded to the body to obtain a head main body.

A socket was obtained by injection molding. A thermoplastic polyurethane elastomer was used for the material of the socket. Specifically, a product material obtained by mixing "Elastollan 1164D" with "Elastollan 1198A" at a weight ratio of 1:1 was used. The cross-sectional area X was 3.27 $mm^2$. The cross-sectional area Y was 3.27 $mm^2$.

A tungsten nickel alloy (W—Ni alloy) was used for the material of a weight body. The W—Ni alloy was molded by powder sintering to obtain the weight body. The mass of the weight body was 11 g.

The socket was inserted into the socket housing portion. The socket was inserted from the outer side of the head. The socket was bonded to the socket housing portion using an adhesive.

"DP460" (trade name) manufactured by Sumitomo 3M Ltd. was used for the bonding. Moreover, the ring member was attached by screw joining. The ring member was screwed until the held portion was pressed.

The weight body was attached to the socket using the tool 60 described above. As a result, a head according to the first example was obtained. The head according to the first example and a grip were attached to a shaft, and a club according to the first example was obtained.

Second Example

A club according to a second example was obtained similarly to the first example except that no adhesive was used in attaching the socket.

Third Example

A socket housing portion and a socket were modified to the form illustrated in FIG. 26. The socket was disposed on the socket housing portion in a body to which a face member was not welded yet. The socket was inserted into the socket housing portion from the inner side of the head. In attaching the socket, no adhesive was used. Subsequently, an attachment member was screwed. The attachment member was screwed until the held portion was pressed. Subsequently, the face member was welded to the body. A club according to a third example was obtained similarly to the first example except the points described above.

[Durability Test]

The club was attached to a swing robot, and a commercially available two-piece ball was hit for 10,000 times. The head speed was 54 m/s. In any of the examples, the fixing of the socket to the weight body was maintained during hitting the ball for 10,000 times.

The invention described above can be applied to all golf clubs. The present invention can be used for a wood type club, a utility type club, a hybrid type club, an iron type club, and a putter club, for example.

The description hereinabove is merely an illustrative example, and various modifications can be made in the scope not deviating from the principles of the present invention.

What is claimed is:

1. A golf club head comprising:
a head main body;
an attachment member;
a socket; and
a weight body, wherein:
the head main body includes a socket housing portion;
the socket is attached to the socket housing portion;
the socket housing portion includes a first opening through which the socket can be housed;
the attachment member is mechanically joined to the head main body;
the attachment member is disposed so as to block at least a part of the first opening;
the attachment member controls falling off of the socket from the first opening;
the socket includes a held portion;
the held portion is pressed by the attachment member;
the socket is formed of a polymer whose elastic modulus is lower than an elastic modulus of the head main body; and
the weight body is detachably attached to the socket.

2. The golf club head according to claim 1, wherein:
the first opening is opened to an outer side of the head;
the attachment member is a ring member;
the ring member is disposed so as to block a part of the first opening; and
the ring member includes a second opening through which the weight body can be inserted into the socket.

3. The golf club head according to claim 2, wherein:
relative rotation is enabled between the weight body and the socket;

the relative rotation allows the weight body to be placed at an engaging position and a non-engaging position;

the ring member includes an indication; and the indication facilitates determination whether the weight body is at the engaging position or not.

4. The golf club head according to claim 2, wherein:

the socket further includes an intermediate portion; and the intermediate portion is positioned between the ring member and the weight body.

5. The golf club head according to claim 4, wherein the ring member contacts at least a part of an outer side surface of the intermediate portion.

6. The golf club head according to claim 1, wherein:

the first opening is opened to an inner side of the head;

the socket housing portion further includes a third opening opened to an outer side of the head; and the third opening allows the weight body to be inserted and controls falling off of the socket to the outer side of the head.

7. The golf club head according to claim 1, wherein the held portion is held between the attachment member and the head main body.

8. The golf club head according to claim 1, wherein a space is provided between the held portion and the attachment member.

9. The golf club head according to claim 1, wherein:

the socket further includes an intermediate portion;

the intermediate portion is positioned between the attachment member and the weight body; and the attachment member does not directly contact the weight body.

10. The golf club head according to claim 1, wherein:

the socket housing portion includes a bottom portion;

the bottom portion includes an inward extending portion and a through hole; and the inward extending portion supports a bottom face of the socket.

11. The golf club head according to claim 1, wherein when a specific gravity of the head main body is G1, a specific gravity of the attachment member is G2, and a specific gravity of the socket is G3, the specific gravity G1 is greater than the specific gravity G2, and the specific gravity G2 is greater than the specific gravity G3.

12. The golf club head according to claim 1, wherein:

the socket housing portion includes a side wall portion; and an outer diameter of the side wall portion is constant.

* * * * *